US012503925B1

(12) United States Patent
Dave et al.

(10) Patent No.: US 12,503,925 B1
(45) Date of Patent: Dec. 23, 2025

(54) INTERVENTION-LESS METHOD OF SETTING OPEN HOLE PACKERS

(71) Applicant: Halliburton Energy Services, Inc., Houston, TX (US)

(72) Inventors: Jalpan Piyush Dave, Singapore (SG); Michael Linley Fripp, Singapore (SG); Shanu Thottungal Eldho, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/924,677

(22) Filed: Oct. 23, 2024

(51) Int. Cl.
*E21B 23/04* (2006.01)
*E21B 23/06* (2006.01)

(52) U.S. Cl.
CPC ..... *E21B 23/06* (2013.01); *E21B 23/0412* (2020.05)

(58) Field of Classification Search
CPC ..... E21B 23/0412; E21B 23/06
See application file for complete search history.

(56) References Cited

U.S. PATENT DOCUMENTS 5,531,280 A 7/1996 Steinkamp et al.
7,717,183 B2 5/2010 Ezell et al.
9,447,649 B2 9/2016 Doane et al.
9,708,894 B2 7/2017 Ditzler
2003/0132006 A1 7/2003 Bussear et al.
2004/0149448 A1* 8/2004 Akselberg ..... E21B 34/10 166/373
2018/0142530 A1 5/2018 Bane
2019/0128081 A1 5/2019 Ross et al.
2023/0250706 A1* 8/2023 Mair ..... E21B 23/0412 166/373

FOREIGN PATENT DOCUMENTS

EP 2510190 B1 12/2020

OTHER PUBLICATIONS

International Search Report and Written Opinion for International Patent Application No. PCT/US2024/053689 dated Jul. 23, 2025. PDF file. 8 pages.

* cited by examiner

*Primary Examiner* — Matthew R Buck
(74) *Attorney, Agent, or Firm* — Scott Richardson; C. Tumey Law Group, PLLC

(57) ABSTRACT

A hydraulic ratcheting device that includes an activation chamber, a valve chamber disposed adjacent to the activation chamber, and an activation piston that includes a first piston area exposed to a fluid source, and a second piston area exposed to the valve chamber, where the activation piston is configured to translate forward, in response to a pressure increase on the first piston area, and push a liquid from the valve chamber into the activation chamber using the second piston area.

23 Claims, 13 Drawing Sheets

| | | |
|---|---|---|
| TARGET DEPTH | 6,000 | FT |
| TARGET DEPTH PRESSURE | 3,000 | PSI |
| RESET CHECK VALVE CRACKING PRESSURE | 0 | PSI |
| ACTIVATION CHECK VALVE CRACKING PRESSURE | 3,200 | PSI |
| PISTON AREA A | 1 | $IN^2$ |
| PISTON AREA B | 2 | $IN^2$ |
| SACRIFICAL PRESSURE DEVICE A BREAKING PRESSURE | 200 | PSI |
| SACRIFICAL PRESSURE DEVICE B BREAKING PRESSURE | 2,000 | PSI |
| ACTIVATION CHAMBER VOLUME | 9.5 | $IN^3$ |
| OVERALL CYCLE THRESHOLD | 5 | CYCLES |

FIG. 5A

| TIME | FLUID SOURCE PRESSURE | VALVE CHAMBER PRESSURE | ACTIVATION CHAMBER % FULL | ACTIVATION PISTON POSITION | RESET CHECK VALVE STATE | ACTIVATION CHECK VALVE STATE |
|---|---|---|---|---|---|---|
| T00 | 3,000 PSI | 3,000 PSI | 0% | BACKWARD | CLOSED | CLOSED |
| ••• | | | | | | |
| T01 | **3,500 PSI** | 3,000 PSI | 0% | BACKWARD | CLOSED | CLOSED |
| T02 | 3,500 PSI | 3,000 PSI | 0% | **FORWARD** | CLOSED | CLOSED |
| T03 | 3,500 PSI | **4,000 PSI** | 0% | FORWARD | CLOSED | CLOSED |
| T04 | 3,500 PSI | 4,000 PSI | 0% | FORWARD | CLOSED | **OPEN** |
| T05 | 3,500 PSI | 4,000 PSI | **21%** | FORWARD | CLOSED | OPEN |
| T06 | 3,500 PSI | **3,200 PSI** | 21% | FORWARD | CLOSED | OPEN |
| T07 | 3,500 PSI | 3,200 PSI | 21% | FORWARD | CLOSED | **CLOSED** |
| T08 | **3,000 PSI** | 3,200 PSI | 21% | FORWARD | CLOSED | CLOSED |
| T09 | 3,000 PSI | 3,200 PSI | 21% | **BACKWARD** | CLOSED | CLOSED |
| T10 | 3,000 PSI | **<3,000 PSI** | 21% | BACKWARD | CLOSED | CLOSED |
| T11 | 3,000 PSI | <3,000 PSI | 21% | BACKWARD | **OPEN** | CLOSED |
| T12 | 3,000 PSI | **3,000 PSI** | 21% | BACKWARD | OPEN | CLOSED |
| T13 | 3,000 PSI | 3,000 PSI | 21% | BACKWARD | **CLOSED** | CLOSED |
| ••• | | | | | | |
| T26 | 3,000 PSI | 3,000 PSI | 42% | BACKWARD | CLOSED | CLOSED |
| ••• | | | | | | |
| T39 | 3,000 PSI | 3,000 PSI | 63% | BACKWARD | CLOSED | CLOSED |
| ••• | | | | | | |
| T52 | 3,000 PSI | 3,000 PSI | 84% | BACKWARD | CLOSED | CLOSED |
| ••• | | | | | | |
| T53 | **3,500 PSI** | 3,000 PSI | 84% | BACKWARD | CLOSED | CLOSED |
| T54 | 3,500 PSI | 3,000 PSI | 84% | **FORWARD** | CLOSED | CLOSED |
| T55 | 3,500 PSI | **4,000 PSI** | 84% | FORWARD | CLOSED | CLOSED |
| T56 | 3,500 PSI | 4,000 PSI | 84% | FORWARD | CLOSED | **OPEN** |
| T57 | 3,500 PSI | 4,000 PSI | **>100%** | FORWARD | CLOSED | OPEN |

FIG. 5B

INTERVENTION-LESS METHOD OF SETTING OPEN HOLE PACKERS

BACKGROUND

The oil and gas industry may use wellbores as fluid conduits to access subterranean deposits of various fluids and minerals which may include hydrocarbons. A drilling operation may be utilized to construct the fluid conduits which are capable of producing hydrocarbons disposed in subterranean formations. Wellbores may be constructed, in increments, as tapered sections, which sequentially extend into a subterranean formation.

BRIEF DESCRIPTION OF DRAWINGS

These drawings illustrate certain aspects of some examples of the present disclosure and should not be used to limit or define the disclosure.

FIG. 5A is a table showing properties of various components of an example hydraulic ratcheting device.

FIG. 5B is a table showing the state and/or value of certain components at sequential time increments.

DETAILED DESCRIPTION

Overview and Advantages

In general, this application discloses one or more embodiments of methods and systems for a hydraulic ratcheting device which may be used with a downhole tool.

For conventional hydrostatically activated tools, fluid (or other pressure) may be added to a borehole to cause the downhole pressure on the tool to exceed a certain threshold. By exceeding that threshold, the tool is activated, and the desired functionality of the tool is achieved.

However, in some instances, an operator of the borehole may desire to add fluids (or other pressure) to the borehole without activating the tool. As a non-limiting example, if the tool is a packer for production tubing, an operator may wish to perform one or more fluid (and/or pressure) tests in the annulus or tubing of the borehole (prior to the packer being set). However, if fluid is added to the borehole that exceeds the activation threshold of the packer, the packer will expand and seal the annulus around the production tubing.

Accordingly, as disclosed in one or more embodiments herein, a hydraulic "ratcheting" device is disclosed that requires two or more pressure increases to activate a tool. That is, a hydraulic ratcheting device may be coupled with a tool and placed downhole. In turn, the hydraulic ratcheting device may require a preset pressure threshold to be exceeded a preset number of times before the accompanying tool is activated. As such, an operator may perform some (limited) number of cycles of fluid introduction and/or pressure cycles (for whatever purpose) before the tool is activated. Further, in one or more embodiments, such a hydraulic ratcheting device may be useful when an operator of the borehole does not desire to use a shifting tool or cup setting tool to activate an adjacent tool.

FIG. 1

Figure 1:
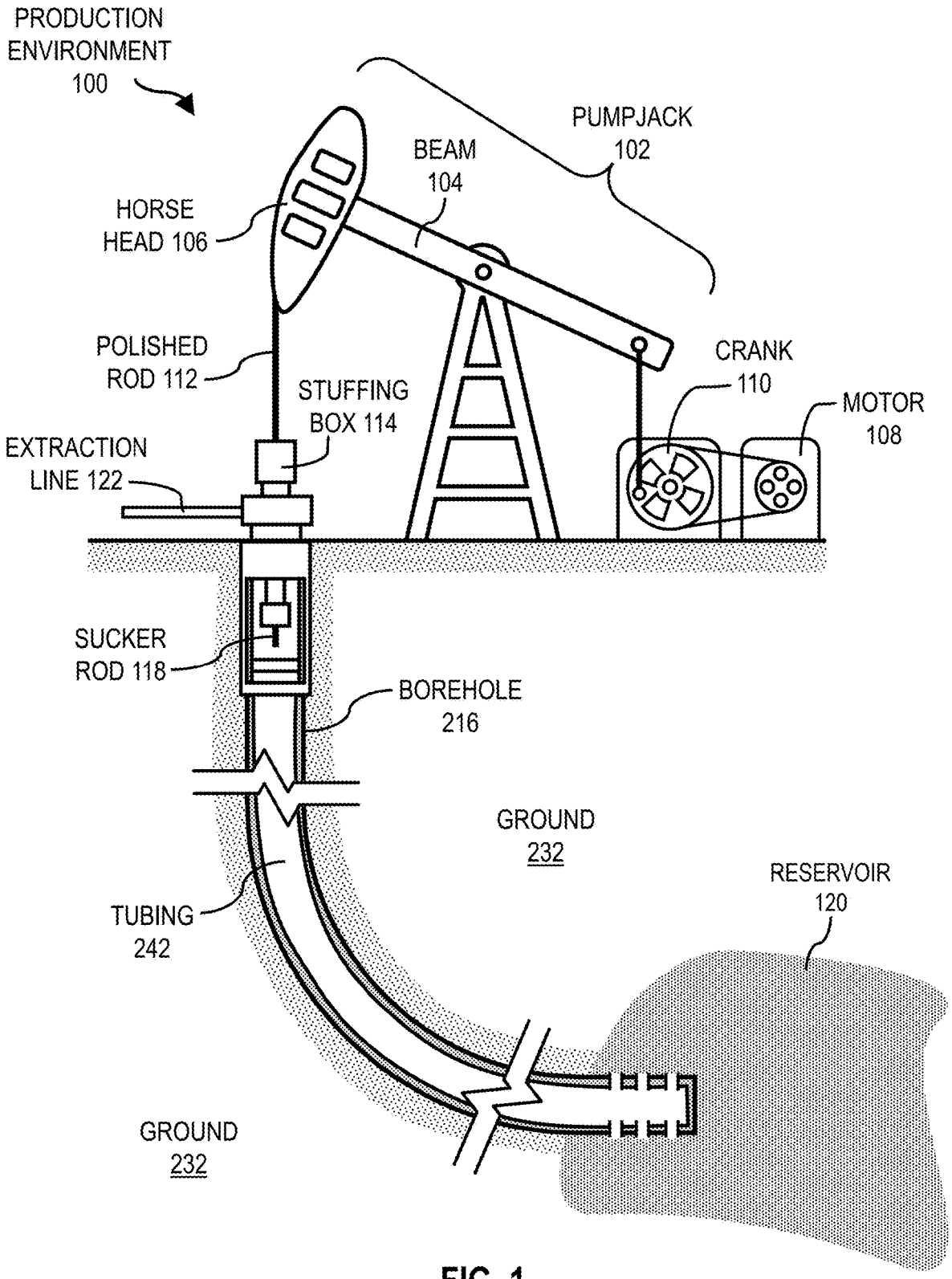
FIG. 1 is a diagram of an example production environment.

FIG. 1 is a diagram of an example production environment. Production environment 100 may include pumpjack 102, controlled by motor 108 and crank 110, and connected to polished rod 112 disposed through stuffing box 114 and connected to sucker rod 118 which are used to extract resources from reservoir 120 through tubing 242. Each of these components is described below.

Pumpjack 102 is a machine which may be used to extract liquid from reservoir 120, via tubing 242, and out through extraction line 122. Pumpjack may be constructed from several other components, including beam 104 and horse head 106. Further, pumpjack 102 may be powered by motor 108, via crank 110, to reciprocate motion of polished rod 112 and sucker rod 118 to create suction in tubing 242 and extract liquid from reservoir 120.

Beam 104, also known as a "walking beam", is a structural component of pumpjack 102. Horse head 106 may be disposed at one distal end of beam 104, while at the opposite distal end, beam 104 may be coupled to crank 110 (e.g., directly or indirectly via an arm, counterweight, or other structural member). Crank 110 may cause the attached end of beam 104 to reciprocate move up-and-down, thereby causing beam 104 to pivot and move horse head 106 down-and-up, respectively, at the opposite end of beam 104. Accordingly, beam 104 may be used, as one of several components, to translate energy from motor 108 to sucker rod 118.

Horse head 106 is a structural component of pumpjack 102. Which may be disposed at a distal end of beam 104 and coupled to polished rod 112 (e.g., directly or indirectly via cabling, or another structural member). Horse head 106 may have an outwardly curved (i.e., convex) surface, disposed opposite beam 104, which may provide a surface against which cabling (not shown) may rest when horse head 106 is lifted upward (as shown) and move away from when lowered. The curved surface of horse head 106 allows for polished rod 112 to translate vertically (i.e., with minimal lateral forces) as beam 104 pivots.

Motor 108 is an electromechanical device which may be used to convert non-mechanical energy from a source (e.g., electricity, combustible fuel, etc.) into mechanical energy (e.g., torque). Accordingly, as motor 108 operates over time, motor 108 may be considered to convert one type of power to another type of power (e.g., electrical power into rotational power). Motor 108 may be configured to include one or more shaft(s) which are used to transfer generated rotational power to other mechanical devices (e.g., directly or indirectly via gears, wheels, belts, etc.). Motor 108 may cause crank 110 to rotate. One of ordinary skill in the art, provided the benefit of this detailed description, would understand the function and operation of a motor.

Crank 110 is a machine component which may be used to convert circular motion to reciprocating motion. As depicted, crank 110 (when caused to rotate by motor 108), causes a distal end of beam 104 to undergo a reciprocating partial rotation (i.e., sweeping back-and-forth over an arc around the pivot point of beam 104). In turn, the pivoting motion of beam 104 causes the opposite distal end (i.e., with horse head 106) to undergo an opposite reciprocating partial rotation. One of ordinary skill in the art, provided the benefit of this detailed description, would understand the function and operation of a crank.

Polished rod 112 is a machine component which (along with sucker rod 118) may be used to create suction in tubing 242. Horse head 106 may be used to forcibly pull polished rod 112 up, while gravity (and suction within tubing 242) are used to pull polished rod 112 downward. Stuffing box 114 may be used to provide a gas and liquid seal around polished rod 112 to allow for the suction to be pulled within tubing 242. Polished rod 112 may be constructed from any suitable materials (e.g., stainless steel, fiberglass, etc.) and further made sufficiently smooth (e.g., minimal surface roughness) to provide for a better seal and easier translation with stuffing box 114.

Stuffing box 114 is a structure which may form a seal around polished rod 112 and allow polished rod 112 to repeatedly reciprocate therethrough. In one or more embodiments, stuffing box 114 provides a gas- and/or liquid-tight seal around polished rod 112, allowing polished rod 112 to translate (e.g., slide) in-and-out of stuffing box 114 without allowing gas and/or liquid to escape through the opening. Stuffing box 114 may be rigidly installed in tubing 242 and/or above tubing 242 at the surface. Stuffing box 114 may be constructed from any suitable material for sealing (e.g., synthetic rubber) and contoured (e.g., with ribs, sleeves, deflecting membranes, etc.) to provide for a sufficiently constant seal with polished rod 112.

Sucker rod 118 is a machine component which (along with polished rod 112) may be used to create suction in tubing 242. Horse head 106 may be used to forcibly pull sucker rod 118 up (as the force is transferred through polished rod 112), while gravity (and suction within tubing 242) are used to pull sucker rod 118 downward. Stuffing box 114 may be used to provide a gas and liquid seal around polished rod 112 to allow for the suction to be pulled within tubing 242. Accordingly, sucker rod 118 may be used to remove gaseous matter from within tubing 242 and "pull" liquid upward to fill the vacuum created by the removed gas.

Reservoir 120 is a collection of one or more hydrocarbon deposit(s). A hydrocarbon deposit is an aggregation of matter which may store energy in chemical bonds. Non-limiting examples of a hydrocarbon include petroleum and natural gas. Hydrocarbons may form from organic matter and reside in isolated fluid deposits underground (e.g., as a pool) or dispersed within solid matter (e.g., within a shale formation) requiring hydraulic fracturing to separate and extract.

Extraction line 122 is a hollow tube through which extracted liquid may traverse when brought to the surface of production environment 100. Liquid may be brought to extraction line 122 via suction forces created by polished rod 112 and/or sucker rod 118. Extraction line 122 may run parallel to an exhaust line (not shown) where gaseous matter (sucked from tubing 242) is vented.

Figure 2:
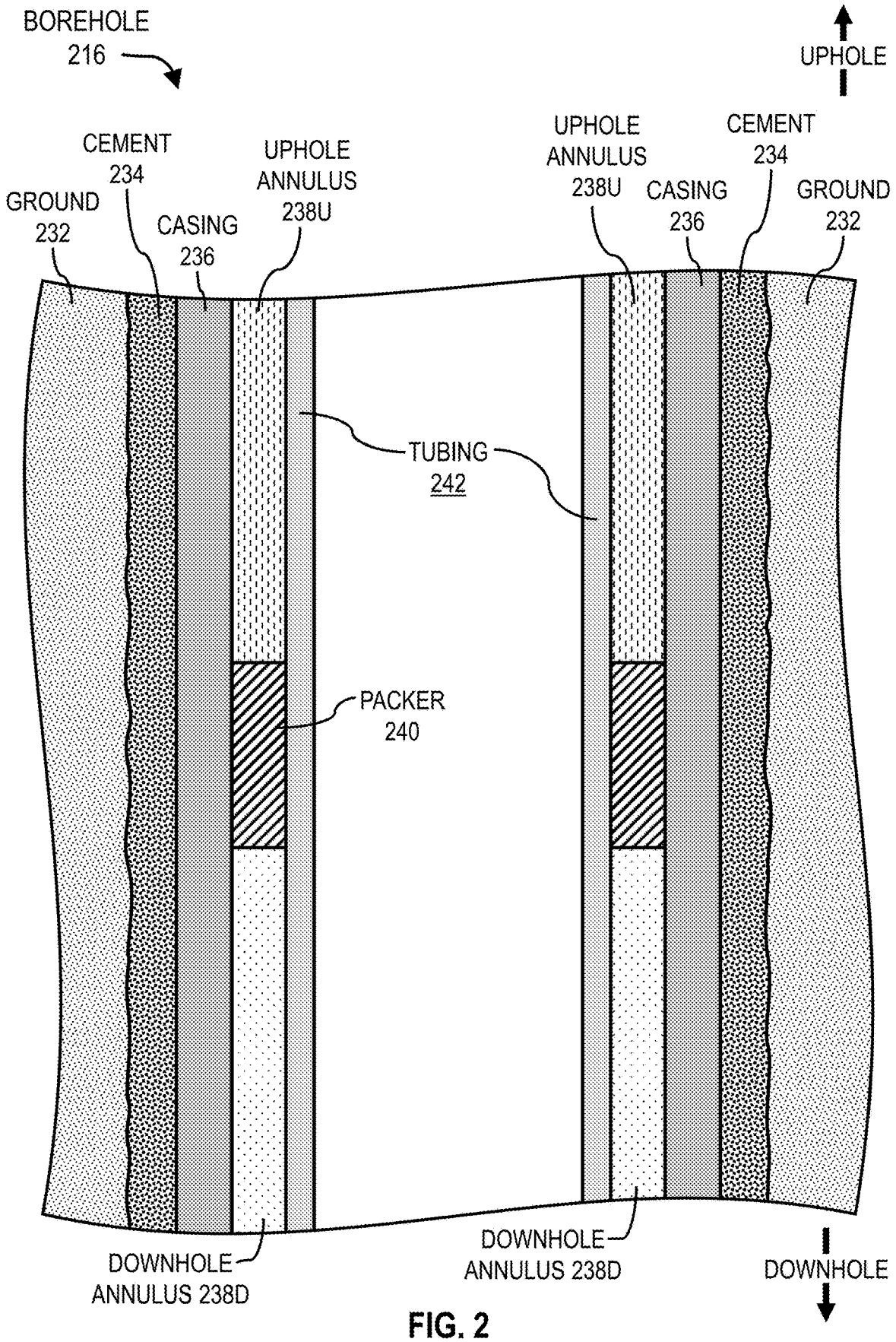
FIG. 2 is a diagram of an example borehole section.

Additional details regarding borehole 216, ground 232, and tubing 242 may be found in the description of FIG. 2.

FIG. 2

FIG. 2 is a diagram of an example borehole section. Borehole 216 may include cement 234 to isolate ground 232 and hold casing 236 in position. In turn, tubing 242 may be installed in casing 236, where packer 240 surrounds a portion of tubing 242 separating uphole annulus 238U from downhole annulus 238D. Each of these components is described below.

Borehole 216 is a hole in the ground which may be formed by a drillstring and a drill bit disposed thereon (not shown). Borehole 216 may be partially or fully lined with casing 236 to protect the surrounding ground 232 from the contents of borehole 216, and conversely, to protect borehole 216 from the surrounding ground 232.

Ground 232 is the surface and subsurface of Earth. In one or more embodiments, borehole 216 may be formed in ground 232 (e.g., using a drill bit). Reservoirs (or other resource deposits) may be disposed in ground 232, which may be accessed via one or more borehole(s) 216.

Cement 234 is a binding material which may be used to set casing 236 in position in borehole 216. In one or more embodiments, borehole 216 may be created with uneven or pitted walls and/or with other cavities, voids, or dead ends. In such scenarios, cement 234 may act to fill those voids between ground 232 and casing 236 and thereby ensure solid support around casing 236.

Casing 236 is a structure which may be installed into borehole 216 and fixed in place via cement 234. In one or more embodiments, casing 236 is steel pipe which may be constructed in sections (e.g., 30 feet, 50 feet) and threaded into adjoining segments during installation.

Annulus 238, generally, is a void between casing 236 and tubing 242 which may be filled with a fluid (i.e., a liquid or gas). In one or more embodiments, the outer diameter of tubing 242 is constructed with a smaller diameter than the internal diameter of casing 236. Accordingly, tubing 242 may be inserted (and installed) into casing 236 with an open volume therebetween (i.e., annulus 238).

Uphole annulus 238U is a portion of annulus 238 (around tubing 242 and inside casing 236) that is separated from downhole annulus by packer 240. In one or more embodiments, uphole annulus 238U may be filled with a liquid or gas, which may be circulated from the surface.

Downhole annulus 238D is a portion of annulus 238 (around tubing 242 and inside casing 236) that is separated from uphole annulus 238U by packer 240. In one or more embodiments, downhole annulus 238D may be filled with a liquid or gas, and in fluid contact with a reservoir.

Packer 240 (i.e., "packing element") is a mechanical device which may be used to isolate annulus 238 into two sections (e.g., uphole annulus 238U and downhole annulus 238D). In one or more embodiments, by isolating downhole annulus 238D from uphole annulus 238U, the contents of a reservoir may be constrained to flow through only designated channels (e.g., tubing 242). Further, contents of uphole annulus 238U may be pumped, circulated, or otherwise exchanged without loss to a reservoir further downhole.

Tubing 242 is a structure which may be placed in borehole 216 and act as a conduit for fluids. In one or more embodiments, tubing 242 may be used for the extraction of resources from a reservoir (e.g., production tubing). To prevent the flow of fluids through borehole 216 outside of tubing 242, tubing 242 may be circumscribed by packer 240 (or another sealing device) which may then prevent the flow of fluids past packer 240 (i.e., into uphole annulus 238U).

In one or more embodiments, borehole 216 may lack cement 234 or casing 236. Such boreholes 216 are called "open hole" completions, where tubing 242 is disposed directly into borehole 216 adjacent to ground 232. In such "open hole" completions, tubing 242 generally remains fluidically coupled to the annulus 238 via sand screens (or other tools). Accordingly, for "open hole" completions, an operator of borehole 216 may refrain from applying high pressure to borehole 216 as ground 232 may be directly affected, potentially fracturing the formation. In such cases, it may be important for an operator of borehole 216 to be able to activate a downhole tool 474 (e.g., such as packer 240) (i) without building a differential pressure between tubing 242 and annulus 238, (ii) without having to run shifting tools (costing time and money), and/or (iii) whilst allowing multiple (two or more) low pressure cycles to be applied and allow, for example, circulation of fluid in borehole 216.

FIGS. 3A-3B

Figure 3A:
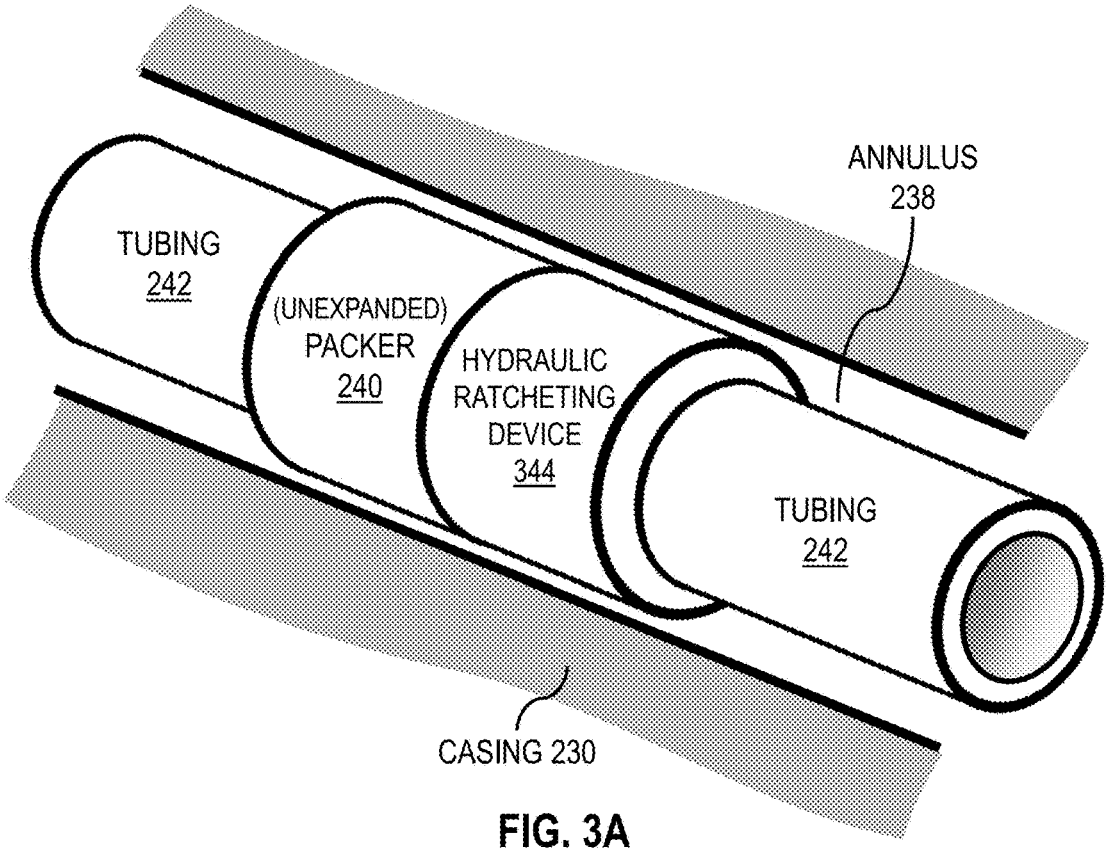
FIG. 3A is a diagram of an unexpanded packer with a hydraulic ratcheting device in a borehole.
Figure 3B:
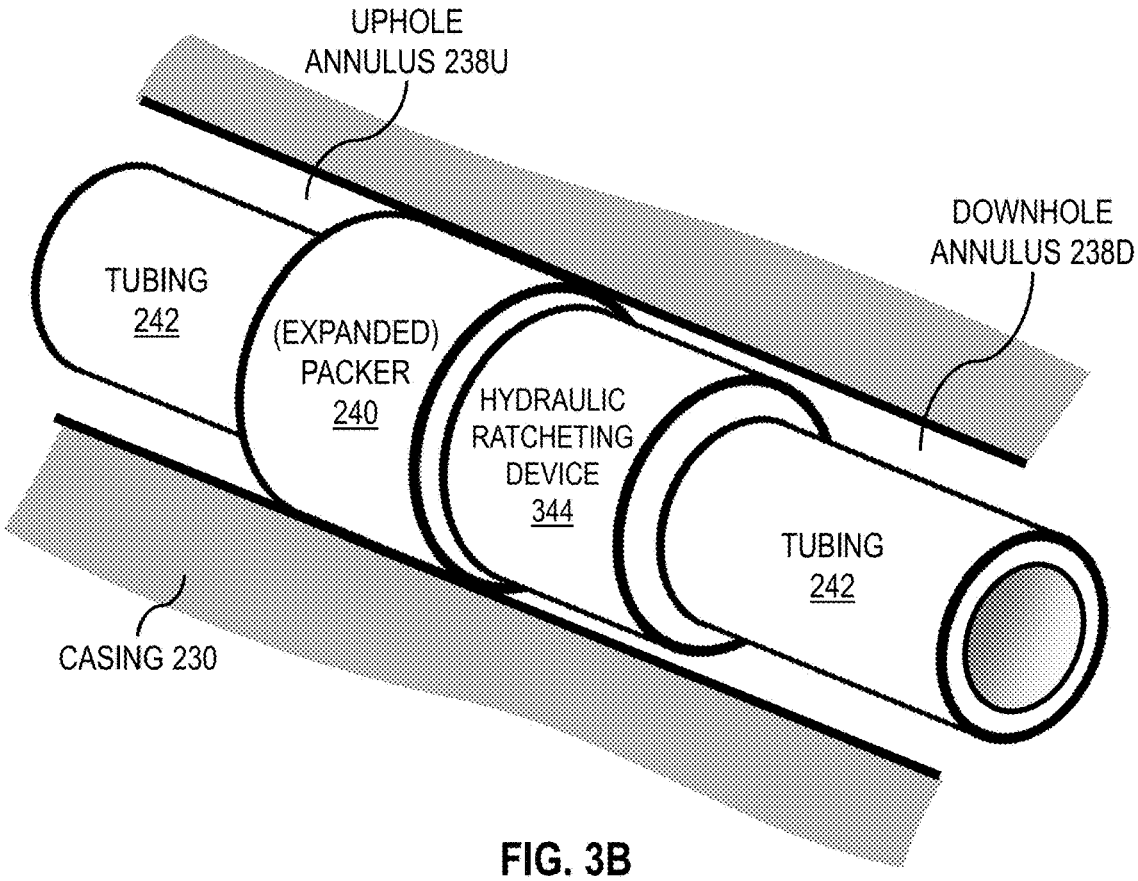
FIG. 3B is a diagram of an expanded packer with a hydraulic ratcheting device in a borehole.

FIG. 3A is a diagram of an unexpanded packer with a hydraulic ratcheting device in a borehole. FIG. 3B is a diagram of an expanded packer with a hydraulic ratcheting device in a borehole.

Hydraulic ratcheting device 344 is a machine which may be used to cause an increase in pressure to an attached volume and/or to pump fluid into an attached volume. In one or more embodiments, the increase in pressure may, in turn, be used to actuate a piston, ball valve, and/or sleeve of another tool 474 (e.g., packer, plug, shifting tool). Additional details regarding the hydraulic ratcheting device 344 may be found in the description of FIGS. 4A-4C.

As shown in the example of FIGS. 3A-3B, hydraulic ratcheting device 344 may be used to set packer 240. Specifically, tubing 242 (with packer 240 and hydraulic ratcheting device 344 attached thereto) may be run in borehole 216 and positioned to a desired depth and/or location. Once the desired depth is reached, packer 240 is expanded ("set") using hydraulic ratcheting device 344 and locked into position against casing 230 (or an "open hole" against ground 232, as the case may be). One of ordinary skill in the art, provided the benefit of this detailed description, would understand that packer 240 and hydraulic ratcheting device 344 may be constructed and/or packaged as a single product.

FIGS. 4A-4E

Figure 4A:
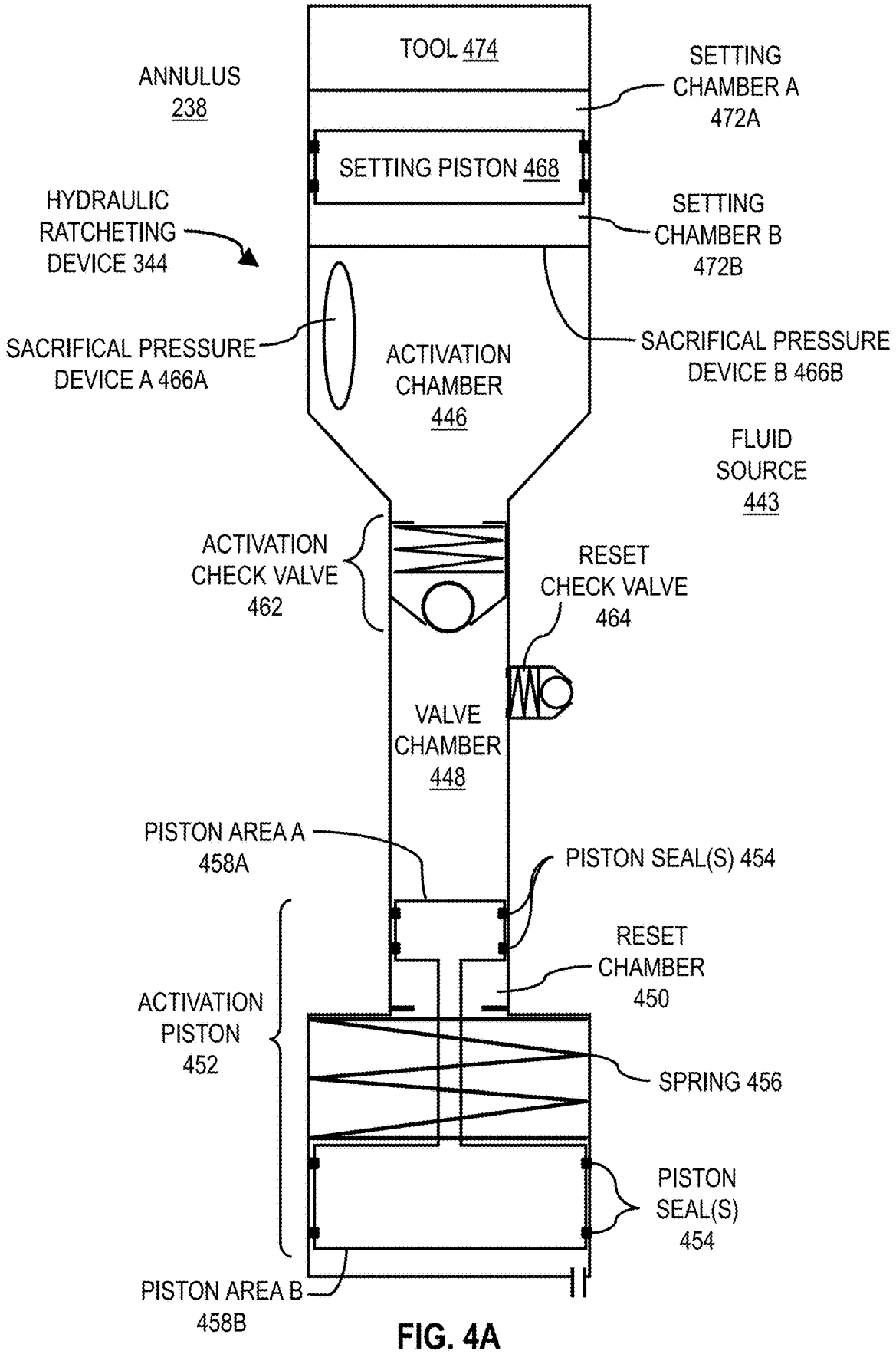
FIG. 4A is a diagram of a hydraulic ratcheting device affixed to a setting piston and shifting tool.
Figure 4B:
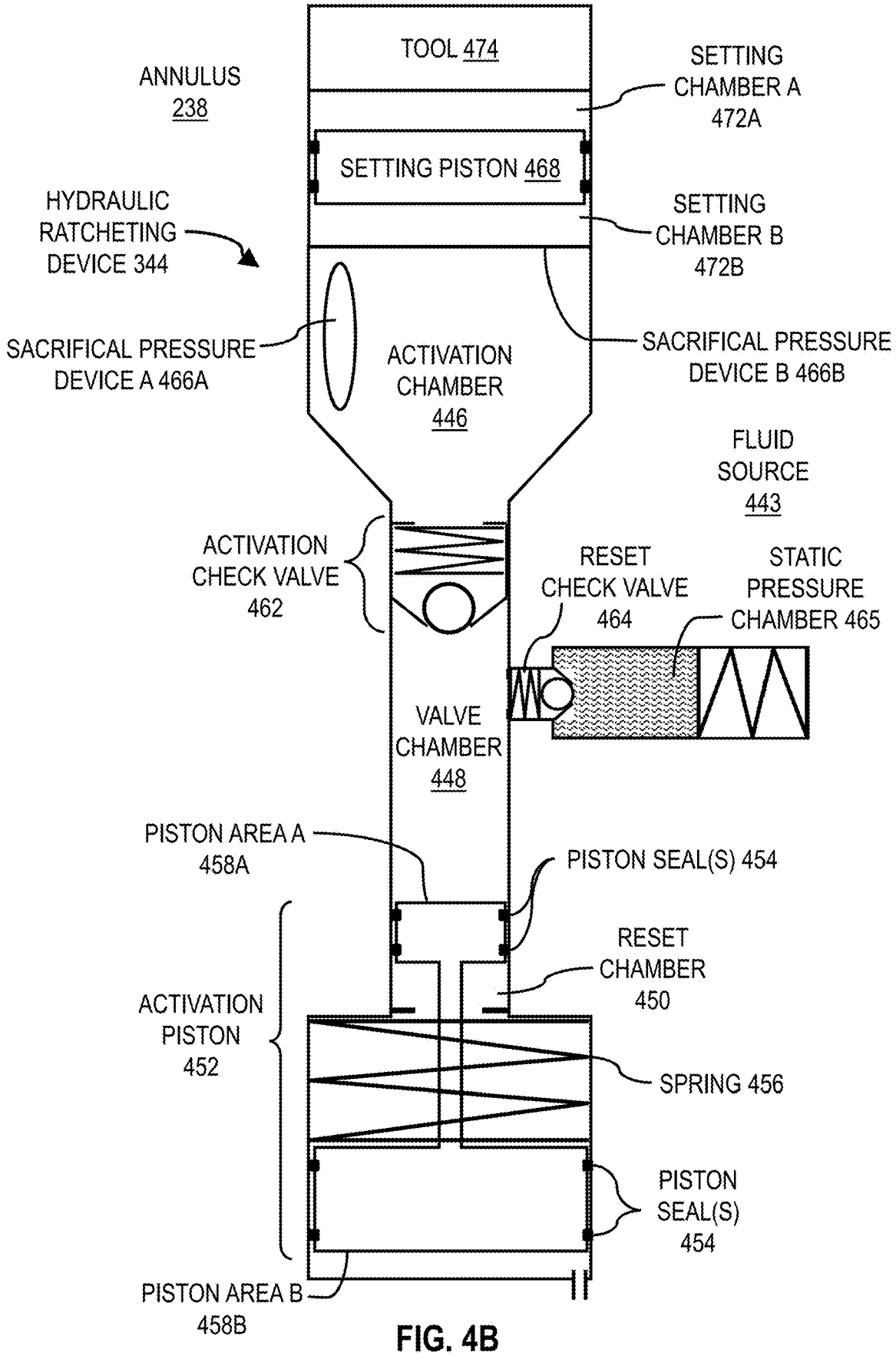
FIG. 4B is a diagram of a hydraulic ratcheting device with a static pressure chamber.
Figure 4C:
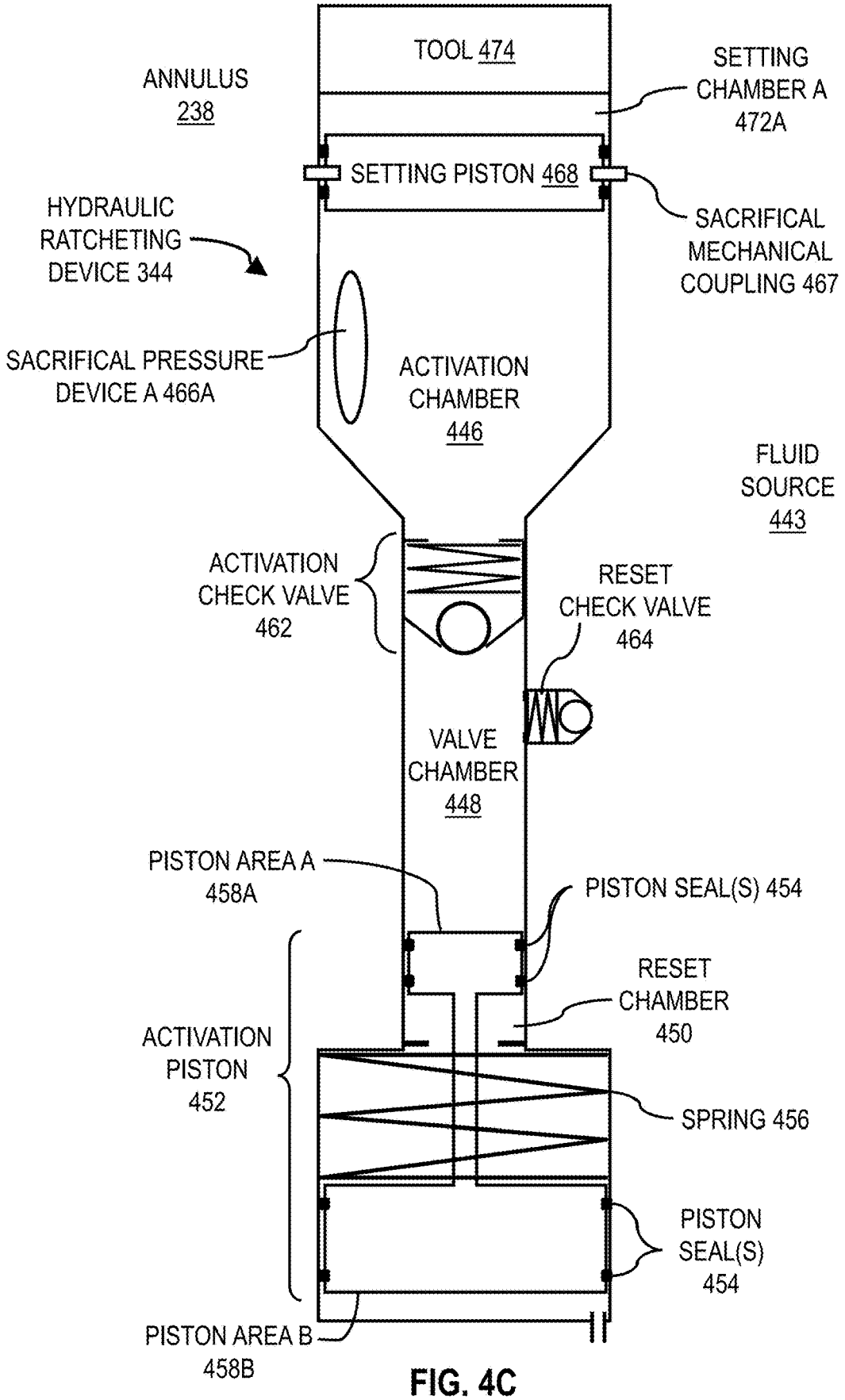
FIG. 4C is a diagram of a hydraulic ratcheting device with a sacrificial mechanical coupling.
Figure 4D:
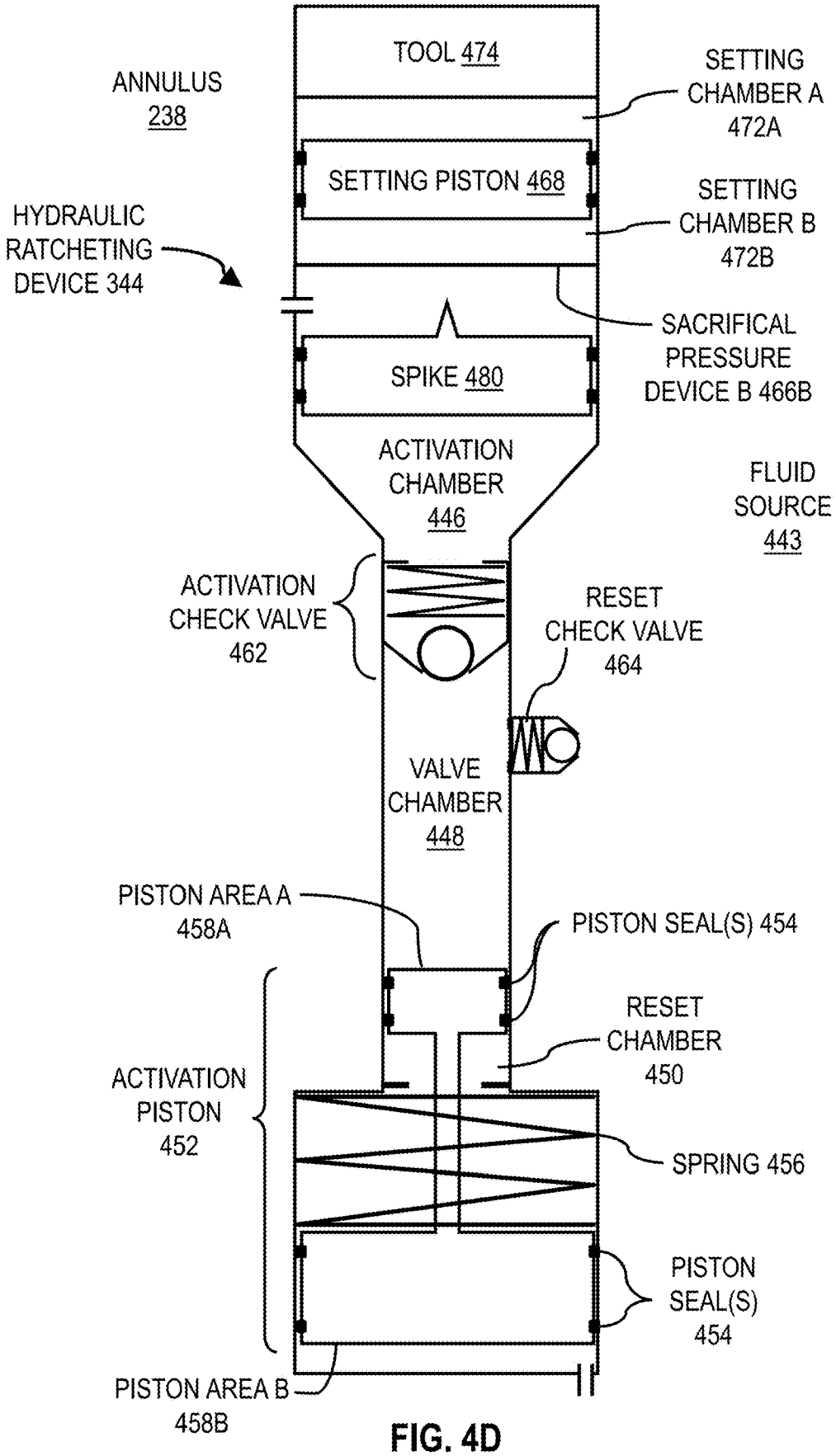
FIG. 4D is a diagram of a hydraulic ratcheting device with a spike.
Figure 4E:
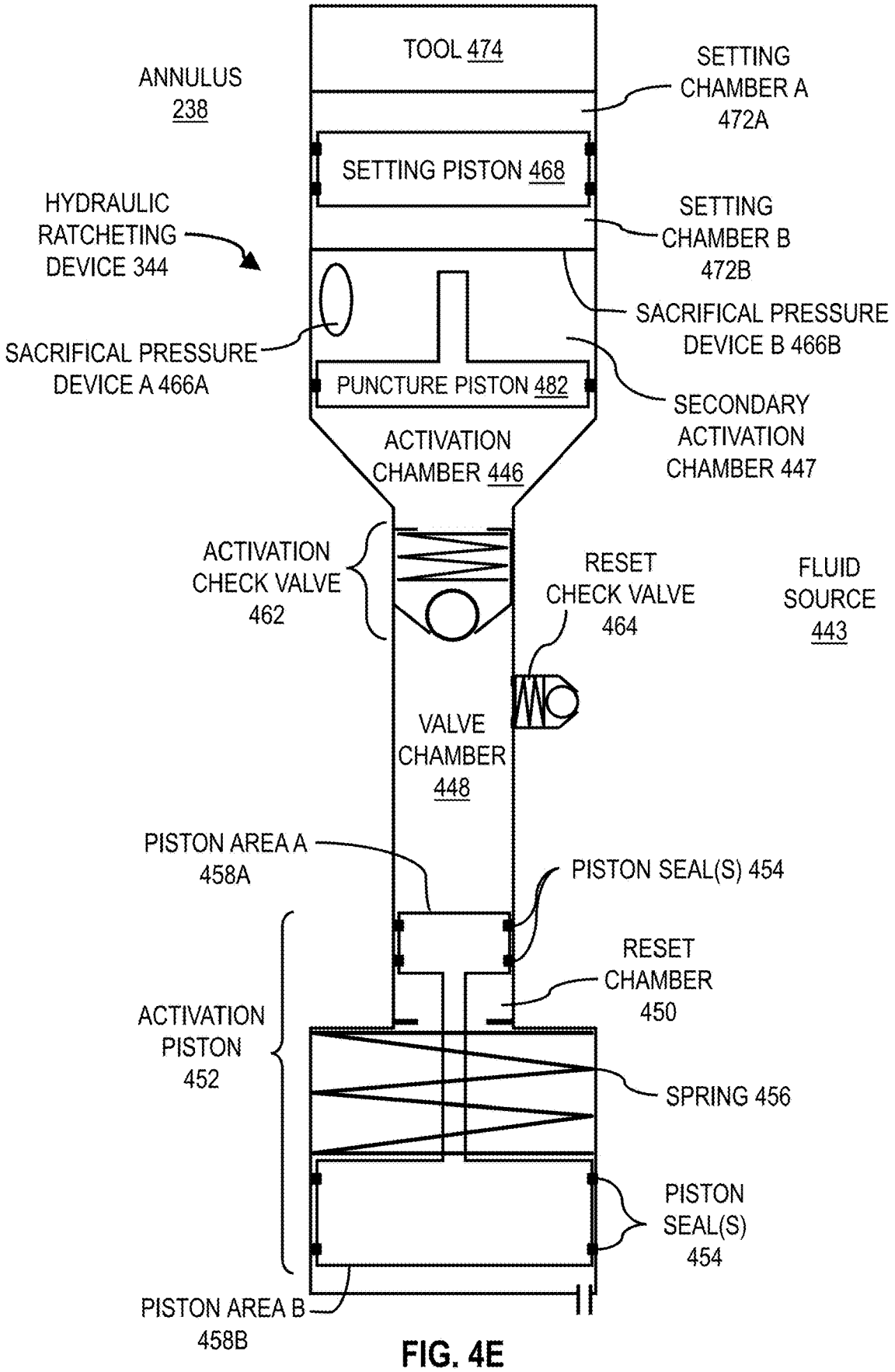
FIG. 4E is a diagram of a hydraulic ratcheting device with a puncture piston.

FIG. 4A is a diagram of a hydraulic ratcheting device affixed to a setting piston and shifting tool. FIG. 4B is a diagram of a hydraulic ratcheting device with a static pressure chamber. FIG. 4C is a diagram of a hydraulic ratcheting device with a sacrificial mechanical coupling. FIG. 4D is a diagram of a hydraulic ratcheting device with a spike. FIG. 4E is a diagram of a hydraulic ratcheting device with a puncture piston.

Hydraulic ratcheting device 344 is a machine which may be used to cause an increase in pressure to an attached volume and/or to pump fluid into an attached volume. In one or more embodiments, the increase in pressure may, in turn, be used to actuate a piston, ball valve, and/or sleeve of another tool (e.g., a packer, plug, shifting tool, etc.). In one or more embodiments, hydraulic ratcheting device 344 may include one or more internal volume(s) (e.g., activation chamber 446, valve chamber 448, reset chamber 450) which are separated by one or more component(s) (e.g., activation piston 452, activation check valve 462, reset check valve 464). Each of these components is described below.

Fluid source 443 is a volume fluidically connected to piston area B 458B, reset check valve 464, and a side of sacrificial pressure device A 466A. Additionally, fluid source 443, may be fluidically connected to annulus 238 and/or tubing 242. In one or more embodiments, a user (e.g., an operator) may add fluid (otherwise cause an increase in pressure) to fluid source 443 by interacting with fluid in annulus 238, tubing 242, or both annulus 238 and tubing 242.

Activation chamber 446 is an internal volume of hydraulic ratcheting device 344 which may be used to open one or more sacrificial pressure device(s) 466. In one or more embodiments, activation chamber 446 is installed (e.g., disposed in position downhole) with very low comparative pressure (e.g., atmospheric, vacuum) to that of fluid source 443 pressure. In one or more embodiments, once the pressure in activation chamber 446 reaches a certain threshold, one or more sacrificial pressure devices (e.g., sacrificial pressure device A 466A, sacrificial pressure device B 466B) may break and cause the adjoining volume to become continuous with activation chamber 446.

Valve chamber 448 is an internal volume of hydraulic ratcheting device 344 which may be used to cycle through varying pressures to force fluid into activation chamber 446. In one or more embodiments, fluid may flow into valve chamber 448 from fluid source 443, through reset check valve 464. In one or more embodiments, fluid may flow into valve chamber 448 from tubing 242 (not shown), through reset check valve 464. In another embodiment, fluid may flow into valve chamber 448 from static pressure chamber 465 fluidly connected to reset check valve 464. Further, in one or more embodiments, fluid may flow out of valve chamber 448 via activation check valve 462. The volume of valve chamber 448 may increase and decrease depending on the position of activation piston 452. Consequently, the pressure in valve chamber 448 may decrease and increase, respectively.

Reset chamber 450 is a volume which surrounds a middle portion of activation piston 452 (between piston area A 458A and piston area B 458B). In any embodiment, reset chamber 450 may be "pre-charged" and filled with a gas (or gas-liquid combination) to maintain a static absolute pressure when activation piston 452 is stationary (thereby allowing hydraulic ratcheting device 344 to be used at a desired depth). That is, in any embodiment, spring 456 may be limited to a certain size to exert a certain force (with an inability to install a larger, more powerful spring 456). As such, there is a depth limitation to the where hydraulic ratcheting device 344 may be installed as the hydrostatic head of the liquid prevents spring 456 from returning activation piston 452 to the backward position. To exert additional backward counteracting forces on activation piston 452, reset chamber 450 may be "pre-charged" to a pressure that sufficiently neutralizes the change in forces caused by the depth.

Activation piston 452 is a rigid structure used to translate force and/or pressure to another body and/or volume. In any embodiment, activation piston 452 may be controlled to move via hydraulics (e.g., from changes in pressure in the volumes disposed at either distal end). As shown in FIG. 4, activation piston 452 may be used to increase pressure in valve chamber 448. In any embodiment, activation piston 452 may translate at least partially within reset chamber 450 along the length of hydraulic ratcheting device 344. Activation piston 452 may include one or more section(s) with larger diameter which are used to isolate volumes surrounding different portions of activation piston 452.

Piston seal 454 is an apparatus which circumscribes one or more distal end(s) of activation piston 452. In one or more embodiments, piston seal 454 acts to separate the volume surrounding activation piston 452 into two or more fluidly isolated volumes (e.g., valve chamber 448, reset chamber 450, volume below piston area B 458B). Thus, in any embodiment, valve chamber 448 may be filled with higher pressure fluid (compared to reset chamber 450) and piston seal 454 prevents (or limits) any such fluid from leaking into reset chamber 450 (or vice versa).

Spring 456 is an apparatus which provides constant tension between two bodies. In any embodiment, spring 456 may function by tending to an extended state while allowing elastic compression. Thus, when compressed, spring 456 exerts outward force (i.e., tension) on the bodies that are exerting inward forces (i.e., compression) on spring 456. In any embodiment, spring 456 may be used to aide in moving activation piston 452 out of valve chamber 448 and keeping force thereon. In any embodiment, spring 456 may be centered around activation piston 452.

Piston area 458, generally, is a cross-sectional area at an exposed distal end of activation piston 452. In one or more embodiments, piston area 458 is exposed to volumes surrounding activation piston 452 (e.g., valve chamber 448, volume below piston area B 458B). Piston area A 458A is the exposed piston area 458 of activation piston 452 facing valve chamber 448. Piston area B 458B is the exposed piston area 458 of activation piston 452 that is exposed to volume on the opposite side of activation piston 452 from valve chamber 448. In any embodiment, piston area A 458A and piston area B 458B may have different cross-sectional areas. As such, the forces exerted on each exposed piston area 458 may differ, even when both piston area 458 are exposed to the same pressure. As a non-limiting example, if piston area B 458B is twice as large as piston area A 458A—and both piston areas 458 are exposed to the same pressures—activation piston 452 would experience twice the force coming from the end with piston area B 458B (causing movement of activation piston 452 towards valve chamber 448, if not already at equilibrium).

A check valve, generally, is an apparatus which may be installed between two volumes and allow for the flow of fluid in only one direction (up to a certain pressure). In any embodiment, a check valve may be selected (or modified or configured) to have a "cracking pressure" that limits the flow of fluids in the designated direction. As a non-limiting example, a check valve with a cracking pressure of 10 pounds per square inch (psi) allows fluid to flow therethrough when the pressure on the ingress-side is 10 psi greater than the pressure on the egress-side. Further, a check valve prevents fluid from flowing in the opposite direction (from an egress-side to an ingress-side) until a significantly greater "back pressure" is reached (e.g., 50,000 psi)—causing failure of the check valve. Accordingly, a check valve may be considered "one-way" in environments where the pressure difference between the ingress and egress sides remains lower than the "back pressure" limits of the check valve.

Activation check valve 462 is a check valve which may be installed between activation chamber 446 and valve chamber 448. In one or more embodiments, activation check valve 462 allows for the flow of fluid from valve chamber 448 to activation chamber 446. Further, in one or more embodiments, activation check valve 462 prevents the flow of fluid from activation chamber 446 to valve chamber 448. Activation check valve 462 may be selected (or modified or configured) to have a cracking pressure that is between the controllable ranges of pressures in fluid source 443. As a non-limiting example, if the region of borehole 216 in which hydraulic ratcheting device 344 is placed has a fluid source 443 pressure of 5,000 psi (which may be increased at the surface to 5,500 psi), activation check valve 462 may have cracking pressure of 5,200 psi (between 5,000 and 5,500 psi).

Reset check valve 464 is a check valve which may be installed between valve chamber 448 and fluid source 443. In one or more embodiments, reset check valve 464 allows for the flow of fluid from fluid source 443 to valve chamber 448. Further, in one or more embodiments, reset check valve 464 prevents the flow of fluid from valve chamber 448 to fluid source 443. Reset check valve 464 may be selected (or modified or configured) to have a cracking pressure that is low (e.g., at or close to 0 psi). As a non-limiting example, with a cracking pressure of 0 psi, any time when the pressure in fluid source 443 exceeds the pressure in valve chamber 448, reset check valve 464 opens to neutralize the pressure differential between the two volumes. However, conversely, if the pressure in valve chamber 448 exceeds the pressure in fluid source 443, reset check valve 464 remains closed and allows for valve chamber 448 to maintain a higher comparative pressure.

Static pressure chamber 465 is device which may be used to provide a consistent and/or constant absolute pressure within a designed range of pressures (e.g., between an upper and lower bound). In one or more embodiments (e.g., as shown in FIGS. 4A and 4C), when reset check valve 464 opens (to fluid source 443), debris may lodge into the opening, causing reset check valve 464 become stuck in the "open" position. Consequently, when pressure inside valve chamber 448 becomes equal (or greater) than pressure in fluid source 443, reset check valve 464 may remain open due to the lodged debris. Accordingly, in one or more embodiments, it may be desirable to install static pressure chamber 465, where static pressure chamber 465 isolates reset check valve 464 from fluid source 443 (and any debris therein). That is, in one or more embodiments, static pressure chamber 465 may be prefilled with one or more "clean" fluids (e.g., silicon oil) free of debris and therefore not likely to cause reset check valve 464 to become stuck open. Further, static pressure chamber 465 may include one or more spring(s) or other pressure-causing components to allow static pressure chamber 465 to maintain a pressure (within a range of acceptable pressures) at the opening of reset check valve 464.

Sacrificial pressure device 466, generally, is a mechanism which separates two volumes by preventing the flow of fluid therebetween. In one or more embodiments, a sacrificial pressure device may be designed to open (e.g., break, shatter, etc.) when a differential pressure between two adjacent volumes exceeds a certain threshold (a "breaking pressure"). Further, sacrificial pressure device 466 may have a "weak" side and a "strong" side, where sacrificial pressure device 466 may be designed to open when the pressure on the "weak" side is greater than the pressure on the "strong" side by the required breaking pressure threshold. Similarly, sacrificial pressure device 466 may be designed to break open when the pressure on the "strong" side is greater than a pressure on the "weak" side, by some threshold breaking pressure that is greater than the breaking pressure in the reverse direction. Thus, each sacrificial pressure device 466 may be considered to have two breaking pressures. Non-limiting examples of sacrificial pressure device 466 include a rupture disc or shear pins holding a plate, either of which are designed to break when exposed to a preset breaking pressure.

As a non-limiting example, sacrificial pressure device 466 may have a preset breaking pressure of 200 psi (from the "weak" side). Thus, if the "strong" side experiences an absolute pressure of 3,000 psi and the "weak" side experiences an absolute pressure of 3,100 psi, sacrificial pressure device 466 would remain closed and unbroken, as the pressure differential is only 100 psi greater on the "weak" side than the pressure on the "strong" side. However, if the absolute pressure on the "weak" side is increased to 3,250 psi, the pressure differential increases to 250 psi (i.e., exceeding the 200 psi breaking pressure) and the sacrificial pressure device 466 would open. As another non-limiting example, using the same sacrificial pressure device 466 with a breaking pressure of 200 psi, the "strong" side may be exposed to an absolute pressure of 4,000 psi while the "weak" side may be exposed to an absolute pressure of 50 psi (causing a differential pressure of 3,950 psi). However, in such a scenario, sacrificial pressure device 466 would remain closed as the greater pressure is on the "strong" side. In one or more embodiments, sacrificial pressure device 466 may break open from the "strong side" due to a positive differential pressure on the "strong" side, at a comparatively greater threshold (e.g., 50,000 psi) than is required to break from the "weak" side (e.g., 200 psi).

In one or more embodiments, sacrificial pressure device 466 may be installed with the intention to break open from an increase in pressure on the "strong" side. As a non-limiting example, in instances where the pressure across the two adjacent volumes may be relatively equal (initially), sacrificial pressure device 466 may be installed "backwards". Continuing with the example, consider a scenario where two volumes each start at 3,000 psi—with one volume remaining (relatively) constant at 3,000 psi, while the other volume increases to 3,500 psi causing sacrificial pressure device 466 to break open. In such an instance, sacrificial pressure device 466 may be chosen to have a breaking pressure (from the "strong" side) of 400 psi and a breaking pressure (from the "weak" side) 50 psi. Thus, the sacrificial pressure device 466 may be installed with the "strong" side disposed against the volume that goes from 3,000 psi to 3,500 psi (thereby exceeding the 400 psi breaking pressure).

Sacrificial pressure device A 466A is a sacrificial pressure device 466 which may be positioned between activation chamber 446 and fluid source 443. In one or more embodiments, sacrificial pressure device A 466A is positioned with the intention to cause sacrificial pressure device A 466A to break open from an increase in pressure in activation chamber 446. In one or more embodiments, where activation chamber 446 starts at a comparatively low pressure (compared to fluid source 443), sacrificial pressure device A 466A may be installed such that the weak side is exposed to activation chamber 446, and the strong side is exposed to fluid source 443. Alternatively, in one or more embodiments, where activation chamber 446 starts at a comparatively equal pressure to that of fluid source 443, sacrificial pressure device A 466A may be installed such that the strong side is exposed to activation chamber 446, and the weak side is exposed to fluid source 443.

Sacrificial pressure device B 466B is a sacrificial pressure device 466 which may be positioned between activation chamber 446 and setting chamber B 472B. In one or more embodiments, sacrificial pressure device B 466B is positioned with the intention to cause sacrificial pressure device B 466B to break open from an increase in pressure in activation chamber 446. In one or more embodiments, where activation chamber 446 starts at a comparatively low pressure (compared to setting chamber B 472B), sacrificial pressure device B 466B may be installed such that the weak side is exposed to activation chamber 446, and the strong side is exposed to setting chamber B 472B. Alternatively, in one or more embodiments, where activation chamber 446 starts at a comparatively equal pressure to that of setting chamber B 472B, sacrificial pressure device B 466B may be installed such that the strong side is exposed to activation chamber 446, and the weak side is exposed to setting chamber B 472B. In one or more embodiments, the side of sacrificial pressure device A 466A exposed to activation chamber 446 has a lower breaking pressure than side of sacrificial pressure device B 466B exposed to activation chamber 446. Accordingly, the pressure in activation chamber 446 may control when each sacrificial pressure device 466 breaks open.

Sacrificial mechanical coupling 467 is a component which may be used to limit the movement of setting piston 468 with respect to activation chamber 446, setting chamber A 472A, and tool 474. In one or more embodiments, sacrificial mechanical coupling 467 may be designed to break (e.g., shear) when a threshold breaking force is applied thereto (or at a threshold force within a known range of acceptable forces). After breaking, setting piston 468 may then move without the physical constraints previously caused by sacrificial mechanical coupling 467. Thus, sacrificial mechanical coupling 467 may be chosen (or designed) to break when a certain pressure is applied to setting piston 468, which causes a net force on sacrificial mechanical coupling 467. As a non-limiting example, setting piston 468 may have a piston area of 0.5 square inches ($in^2$) and sacrificial mechanical coupling 467 may be designed to break at a threshold force of 1,600 pounds (lbs) (or within a range of 1,550 lbs to 1,650 lbs (i.e., 1,60050 lbs)). Thus, when a net upward pressure of 3,200 psi (or within the range of 3,100 to 3,300 psi (3,200±100 psi)) is applied to setting piston 468, sacrificial mechanical coupling 467 experiences the requisite force of 1,60050 lbs required to break and allow for free movement of setting piston 468. One of ordinary skill in the art, provided the benefit of this detailed description, would understand that the piston area of setting piston 468 may be sized in combination with sacrificial mechanical coupling 467 such that a threshold pressure applied to setting piston 468 breaks sacrificial mechanical coupling 467.

Setting piston 468 is a rigid structure used to translate force and/or pressure to another body and/or volume. In any embodiment, setting piston 468 may be controlled to move via hydraulics (e.g., from changes in pressure in the volumes disposed at either distal end). As shown in FIG. 4, setting piston 468 may be used to activate tool 474 by shifting towards tool 474 (e.g., into setting chamber A 472A and/or directly into tool 474).

Setting chamber A 472A is the volume exposed on the side of setting piston 468 facing tool 474. In one or more embodiments, setting chamber A 472A may be placed in borehole 216 with very low comparative pressure (e.g., atmospheric, vacuum). In one or more embodiments, when setting piston 468 is caused to move, setting piston 468 moves into and occupies the volume of setting chamber A 472A to interact with tool 474. In one or more embodiments, setting chamber A 472A may be absent, and setting piston 468 may be disposed directly against tool 474. As a non-limiting example, setting piston 468 may be fluidically and/or mechanically coupled to tool 474 such that translation of setting piston 468 causes the actuation of tool 474.

Setting chamber B 472B is the volume exposed on the side of setting piston 468 facing activation chamber 446 (and disposed against sacrificial pressure device B 466B). In one or more embodiments, setting chamber B 472B may be placed borehole 216 with very low comparative pressure (e.g., atmospheric, vacuum). Further, in one or more embodiments, setting chamber B 472B is exposed to sacrificial pressure device B 466B which, when opened, joins activation chamber 446 and setting chamber B 472B into a single volume.

Tool 474 is any tool that may be actuated by setting piston 468. Non-limiting examples of tool 474 include a packing element (packer), plug, ball, shifting tool, sleeve, a setting tool (e.g., to set a packer, to set expandable screen elements, to set a plug), or any other mechanism that uses a piston or valve to actuate.

Spike 480 is a rigid structure which may be used to puncture sacrificial pressure device B 466B. In one or more embodiments, as shown in FIG. 4D, spike 480 may be constructed to have a "sharp" point (e.g., a leading edge disposed near sacrificial pressure device B 466B is less cross-sectional area than a trailing side disposed in activation chamber 446). In turn, the sharp point of spike 480 allows greater pressure to be applied to a small area of sacrificial pressure device B 466B (i.e., the same force applied over a smaller area causes a comparatively greater pressure). Accordingly, as activation chamber 446 is filled with more-and-more liquid (as hydraulic ratcheting device 344 is cycled) spike 480 moves closer-and-closer to sacrificial pressure device B 466B. Eventually, the sharp point of spike 480 makes contact with sacrificial pressure device B 466B (after some preset number of cycles) where the concentrated pressure applied to a small area (on sacrificial pressure device B 466B) causes sacrificial pressure device B 466B to break open. As shown in FIG. 4D, sacrificial pressure device A 466A is not present. Accordingly, the use of spike 480, as shown in the embodiment of FIG. 4D may alleviate the need for such a sacrificial pressure device.

Secondary activation chamber 447 (see FIG. 4E) may be pre-charged to have a pressure similar to that of fluid source 443 (e.g., filled with a liquid to have a pressure which is similar to the expected pressure of fluid source 443, at the desired depth). Accordingly, sacrificial pressure device A 466A may have a significantly lower breaking pressure (than sacrificial pressure device B 466B) to ensure that sacrificial pressure device A 466A breaks open prior to sacrificial pressure device B 466B.

In one or more embodiments, secondary activation chamber 447 may be pre-charged to have a lower pressure than the pressure excepted at depth from fluid source 443 (e.g., 2,000 psi in secondary activation chamber 447 compared to 3,000 psi in fluid source 443). In such embodiments, as a non-limiting example, sacrificial pressure device A 466A may be selected to have a weak side breaking pressure of 150 psi and a strong side breaking pressure of 1,000 psi, such that sacrificial pressure device A 466A may be installed with the strong side exposed to secondary activation chamber 447 (and the weak side exposed to fluid source 443). In such instances, activation chamber 446 fills and moves puncture piston 482 forward causing the pressure in secondary activation chamber 447 to increase accordingly. However, in the event that the pressure in secondary activation chamber 447 increases only by a limited amount (e.g., due to some malfunction or unforeseen complication), sacrificial pressure device A 466A may still be forced open by causing a pressure increase in fluid source 443 (exceeding the 150 psi weak side breaking pressure, assuming the pressure in secondary activation chamber increased to, at least, 2,850 psi). Thus, one of ordinary skill in the art, provided the benefit of this detailed description, would appreciate that the addition of secondary activation chamber 447 may allow for greater flexibility in the design and breaking pressures of sacrificial pressure devices 466 (relative to one another) thereby further ensuring that sacrificial pressure device A 466A breaks before sacrificial pressure device B 466B (or vice versa).

Puncture piston 482 is a rigid structure which may be used to increase the pressure in secondary activation chamber 447 and aid in breaking sacrificial pressure device B 466B. In one or more embodiments, as shown in FIG. 4E, puncture piston 482 is configured to translate towards sacrificial pressure device B 466B as the pressure in activation chamber 446 increases (after a preset number of cycles of hydraulic ratcheting device 344). Further, as puncture piston 482 moves into secondary activation chamber 447, the pressure in secondary activation chamber 447 increases causing sacrificial pressure device A 466A to break open.

In one or more embodiments, sacrificial pressure device B 466B may have a breaking pressure that is significantly greater than that of sacrificial pressure device A 466A and thus will not break open automatically due to the pressure from fluid source 443. In turn, a narrow leading edge (or side) of puncture piston 482 (as shown in FIG. 4E) may continue to push forward (with additional cycles of hydraulic ratcheting device 344) until that leading edge contacts and breaks sacrificial pressure device B 466B (similar to spike 480 shown in FIG. 4D). Additionally, when operating in this state, excess fluid in secondary activation chamber 447 may be forced out of the opening created by sacrificial pressure device A 466A allowing puncture piston 482 to continue moving forward without excessive resistance from a pressure build up in secondary activation chamber 447.

FIGS. 5A-5B

FIG. 5A is a table showing properties of various components of an example hydraulic ratcheting device. FIG. 5B is a table showing the state and/or value of certain components at sequential time increments. All or a portion of the steps shown may be performed by one or more components of hydraulic ratcheting device 344 (see description in FIGS. 4A-4C) or a user thereof. While the various steps in this figure are presented and described sequentially, a person of ordinary skill in the relevant art (having the benefit of this detailed description) would appreciate that some or all steps may be executed in different orders, combined, or omitted, and some or all steps may be executed in parallel.

Prior to T00, as shown in the table of FIG. 5A, an example hydraulic ratcheting device 344 may be disposed at a target depth of 6,000 ft, where the pressure at that depth is 3,000 psi. Reset check valve 464 is installed with a cracking pressure of 0 psi and activation check valve 462 is installed with a cracking pressure of 3,200 psi. Activation piston 452 has a piston area A 458A of 1 $in^2$ and a piston area B 458B of 2 $in^2$. Sacrificial pressure device A 466A is installed with a breaking pressure of 200 psi. Sacrificial pressure device B 466B is installed with a breaking pressure of 2,000 psi. Activation chamber 446 has a volume of 9.5 cubic inches ($in^3$). Accordingly, if 2 $in^3$ of liquid is pushed into activation chamber 446 with each cycle, sacrificial pressure device A 466A will break open during the fifth cycle (allowing for four complete cycles without rupturing).

For simplicity, the pressure of the reset chamber 450, the constant of spring 456, simultaneous movements, intermediate movements, and minor variations in pressure are omitted to avoid cluttering the example. One of ordinary skill in the art, provided the benefit of this detailed description, would understand that reset chamber 450 and spring 456 would be constructed, designed, and/or otherwise selected to operate at the desired depth (6,000 ft) and with the properties of the other components.

At T0, hydraulic ratcheting device 344 and tool 474 are placed in borehole 216 at a depth of 6,000 ft. At that depth, there is a hydrostatic pressure of 3,000 psi in borehole 216. Valve chamber 448 has a pressure of 3,000 psi (either pre-charged or neutralized with fluid source 443 via reset check valve 464). Activation chamber 446 is "empty" but may include gaseous matter and/or a small amount of liquid. The pressure in activation chamber 446 may be small (e.g., 1 atmosphere, 14.7 psi) compared to that of valve chamber 448. Reset check valve 464 and activation check valve 462 are both in the "closed" position.

Further at T00, Activation piston 452 is in the "backward" position. Specifically, as piston area B 458B is 2 $in^2$, activation piston 452 experiences (in part) 6,000 lbs of upward force (3,000 psi×2 $in^2$=6,000 lbs). Conversely, as piston area A 458A is 1 $in^2$, activation piston 452 experiences (in part) 3,000 lbs of downward force (3,000 psi×1 $in^2$=3,000 lbs). Additional forces exerted by spring 456 and the pressure of reset chamber 450 cause activation piston 452 to have a net downward force, putting activation piston 452 in the "backward" position.

At T01, an operator causes a pressure increase in fluid source 443 (e.g., sending a pressure wave down fluid source 443) causing the fluid source 443 pressure to increase to 3,500 psi.

At T02, the 500 psi increase in fluid source 443 pressure causes an additional 1,000 lbs of upward force on activation piston 452. Consequently, activation piston 452 moves from the "backward" position to the "forward" position due to the increase in fluid source 443 pressure (3,500 psi×2 $in^2$=7,000 lbs).

At T03, the pressure inside valve chamber 448 increases to 4,000 psi due to the upward movement of activation piston 452. Specifically, as activation piston 452 moves upward, the volume of valve chamber 448 decreases by 2 $in^3$.

At T04, the increase in pressure of valve chamber 448 causes activation check valve 462 to open, as the threshold cracking pressure of 3,200 psi is surpassed (i.e., 4,000 psi from valve chamber 448 and less than 30 psi from activation chamber 446).

At T05, 2 $in^3$ of liquid are dumped from valve chamber 448 to activation chamber 446 through activation check valve 462. As activation chamber 446 has a volume of 9.5 $in^3$, the dumped 2 $in^3$ of liquid cause activation chamber 446 to be approximately 21% full (i.e., 2÷9.5≈0.21).

At T06, as excess liquid is pushed from valve chamber 448 into activation chamber 446, the pressure in valve chamber 448 drops to the cracking pressure of activation check valve 462 (i.e., 3,200 psi).

At T07, as the differential pressure between activation chamber 446 and valve chamber 448 is no longer at (or above) the cracking pressure (3,200 psi), activation check valve 462 closes and liquid stops flowing into activation chamber 446.

At T08, an operator causes the pressure in fluid source 443 to decrease (from 3,500 psi) back to 3,000 psi.

At T09, the decrease in fluid source 443 pressure causes activation piston 452 to slide into the "backward" position. Specifically, as the pressure on piston area B 458B decreases from 3,500 psi to 3,000 psi, the upward force on activation piston 452 decreases from 7,000 lbs to 6,000 pounds. Consequently, the downward forces on activation piston 452 (caused by spring 456, pressure in reset chamber 450, and pressure in valve chamber 448) exceed the upward forces, and activation piston 452 returns to the "backward" position.

At T10, the translation of activation piston 452 backward causes the volume of valve chamber 448 to increase by 2 $in^2$. Consequently, the pressure in valve chamber 448 decreases to below 3,000 psi as there is 2 $in^2$ less of liquid than at T01 (when activation piston 452 was previously in the "backward" position).

At T11, reset check valve 464 opens to allow liquid to flow from fluid source 443 to valve chamber 448. Specifically, as the pressure in valve chamber 448 drops below 3,000 psi, the pressure differential across reset check valve 464 exceeds the cracking pressure of 0 psi (pressure in fluid source 443 is 3,000 psi whereas pressure in valve chamber 448 is less than 3,000 psi).

At T12, liquid flow from fluid source 443 into valve chamber 448 reducing the pressure differential across reset check valve 464. Accordingly, the pressure in valve chamber 448 rises to 3,000 psi, equaling the pressure in fluid source 443.

At T13, reset check valve 464 closes. After liquid flow from fluid source 443 into valve chamber 448, the pressure in fluid source 443 no longer exceeds the pressure in valve chamber 448 (both equaling 3,000 psi). Accordingly, as the differential pressure (0 psi) does not exceed the cracking pressure (0 psi) of reset check valve 464, the reset check valve 464 closes. Further, at T13, hydraulic ratcheting device 344 is in the same state as at T00 (the position and/or state of each component is the same), with the only difference being that activation chamber 446 is 21% full of liquid.

Accordingly, from T00 to T13, one "cycle" of the hydraulic ratcheting device 344 was completed.

T14-T25 (not shown) is substantially similar to T01-T12, except that activation chamber 446 changes from 21% to 42% (instead of 0% to 21%).

At T26, hydraulic ratcheting device 344 is in the same state as at T00 and T13 (the position and/or state of each component is the same), with the only difference being that activation chamber 446 is 42% full of liquid. Accordingly, from T14 to T26, two "cycles" of the hydraulic ratcheting device 344 have been completed.

T27-T38 (not shown) is substantially similar to T01-T12, except that activation chamber 446 changes from 42% to 63% (instead of 0% to 21%).

At T39, hydraulic ratcheting device 344 is in the same state as at T00, T13, and T26 (the position and/or state of each component is the same), with the only difference being that activation chamber 446 is 63% full of liquid. Accordingly, from T27 to T39, three "cycles" of the hydraulic ratcheting device 344 have been completed.

T40-T51 (not shown) is substantially similar to T01-T12, except that activation chamber 446 changes from 63% to 84% (instead of 0% to 21%).

At T52, hydraulic ratcheting device 344 is in the same state as at T00, T13, T26, and T39 (the position and/or state of each component is the same), with the only difference being that activation chamber 446 is 84% full of liquid. Accordingly, from T40 to T52, four "cycles" of the hydraulic ratcheting device 344 have been completed.

Further, at T52, during the next cycle (the fifth cycle), the sacrificial pressure device(s) 466 will break and tool 474 will be set by an increase in pressure to hydraulic ratcheting device 344.

At T53, an operator causes a pressure increase in fluid source 443 (e.g., sending a pressure wave down fluid source 443) causing the fluid source 443 pressure to increase to 3,500 psi.

At T54, the 500 psi increase in fluid source 443 pressure causes an additional 1,000 lbs of upward force on activation piston 452. Consequently, activation piston 452 moves from the "backward" position to the "forward" position due to the increase in fluid source 443 pressure (3,500 psi×2 $in^2$=7,000 lbs).

At T55, the pressure inside valve chamber 448 increases to 4,000 psi due to the upward movement of activation piston 452. Specifically, as activation piston 452 moves upward, the volume of valve chamber 448 decreases by 2 $in^3$.

At T56, the increase in pressure of valve chamber 448 causes activation check valve 462 to open, as the threshold cracking pressure of 3,200 psi is surpassed (i.e., 4,000 psi from valve chamber 448 and less than 30 psi from activation chamber 446).

At T57, activation piston 452 tries to push 2 $in^3$ of liquid (from valve chamber 448) into activation chamber 446 through activation check valve 462. However, as activation chamber 446 has a volume of 9.5 $in^3$, and already contains 8.0 $in^3$ of water, there is not sufficient volume remaining (1.5 $in^3$) to hold the additional 2 $in^3$ being pushed in.

Consequently, as activation piston 452 pushes the 2 $in^3$ of liquid, activation chamber 446 fills completely (to 100%) and the pressure in activation chamber 446 increases dramatically (beyond 4,000 psi) as additional liquid is forced into the volume (>100%). In turn, sacrificial pressure device A 466A breaks open. For additional details of this portion of the process, see the description of FIGS. 7A-7E.

FIGS. 6A-6F

Figure 6A:
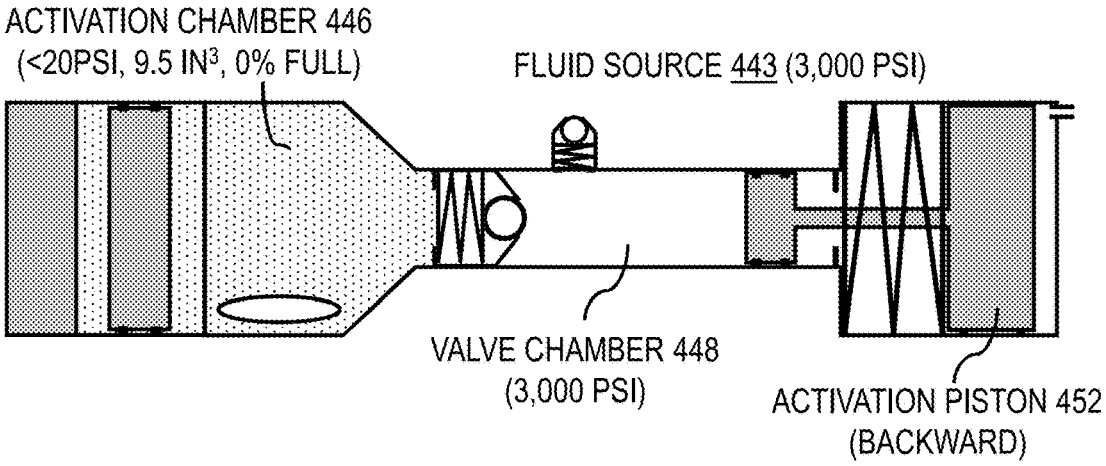
FIG. 6A is a diagram of an example embodiment of a hydraulic ratcheting device after being placed in a borehole, at a desired depth.
Figure 6B:
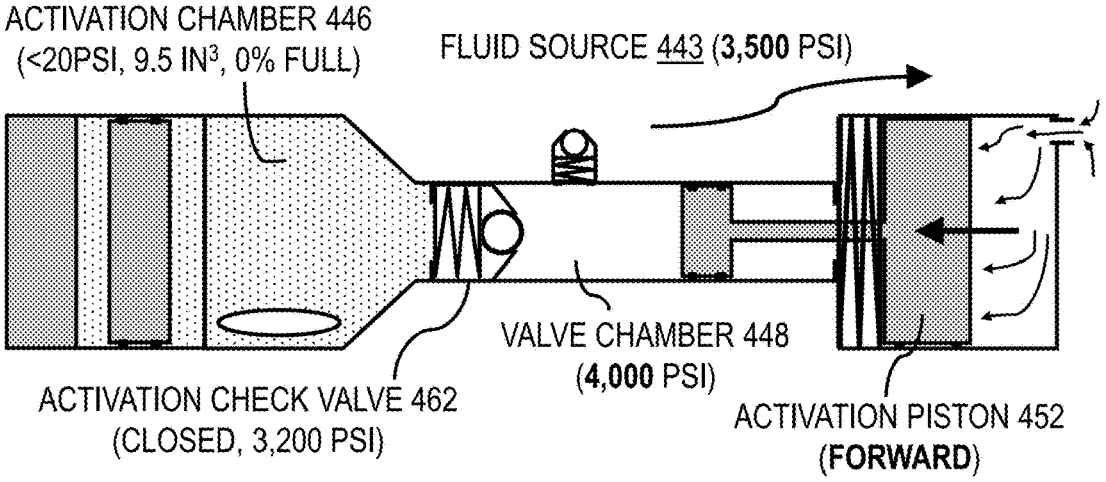
FIG. 6B is a diagram of an example embodiment of a hydraulic ratcheting device after the activation piston is moved forward.
Figure 6C:
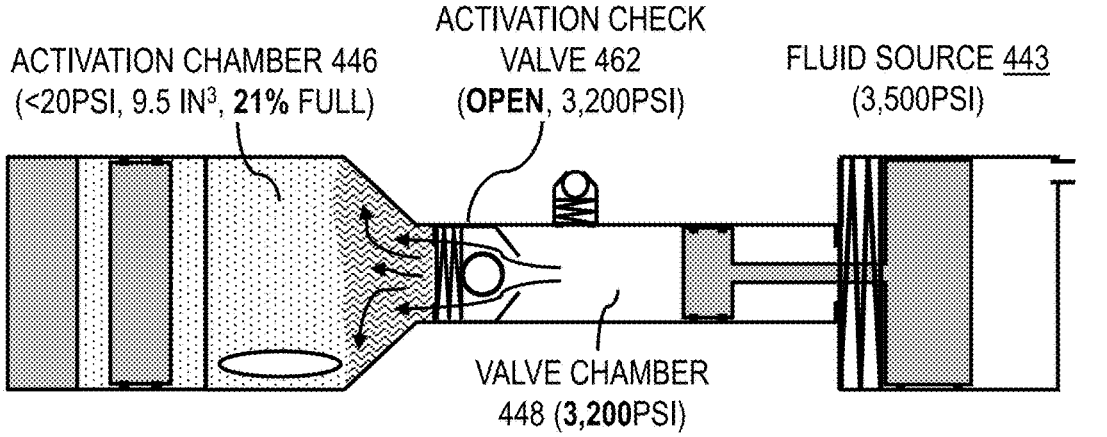
FIG. 6C is a diagram of an example embodiment of a hydraulic ratcheting device after the liquid is pushed into the activation chamber.
Figure 6D:
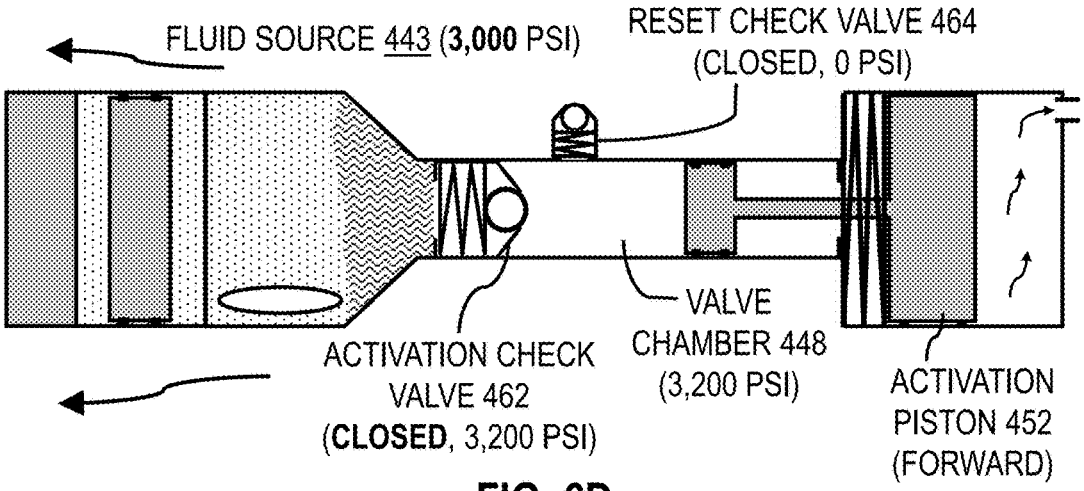
FIG. 6D is a diagram of an example embodiment of a hydraulic ratcheting device after pressure in the borehole is reduced.
Figure 6E:
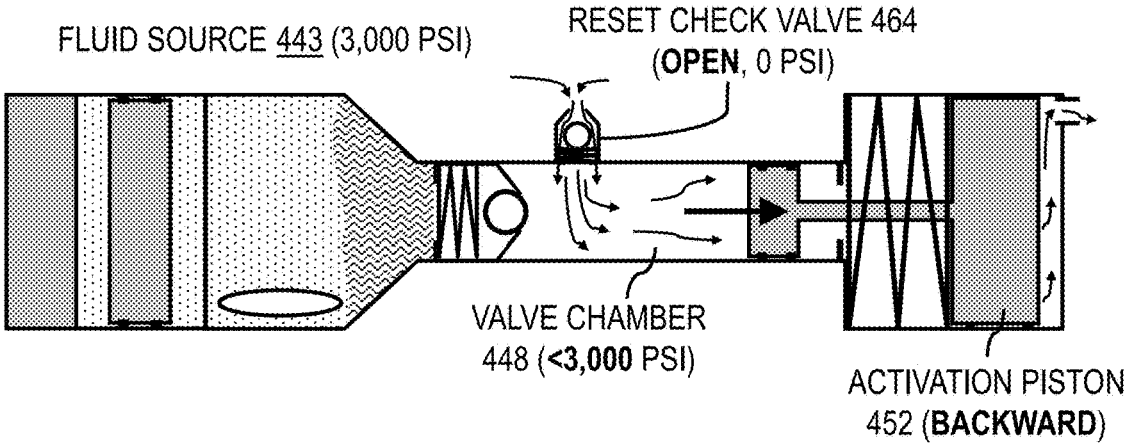
FIG. 6E is a diagram of an example embodiment of a hydraulic ratcheting device after the activation piston is pushed backward.
Figure 6F:
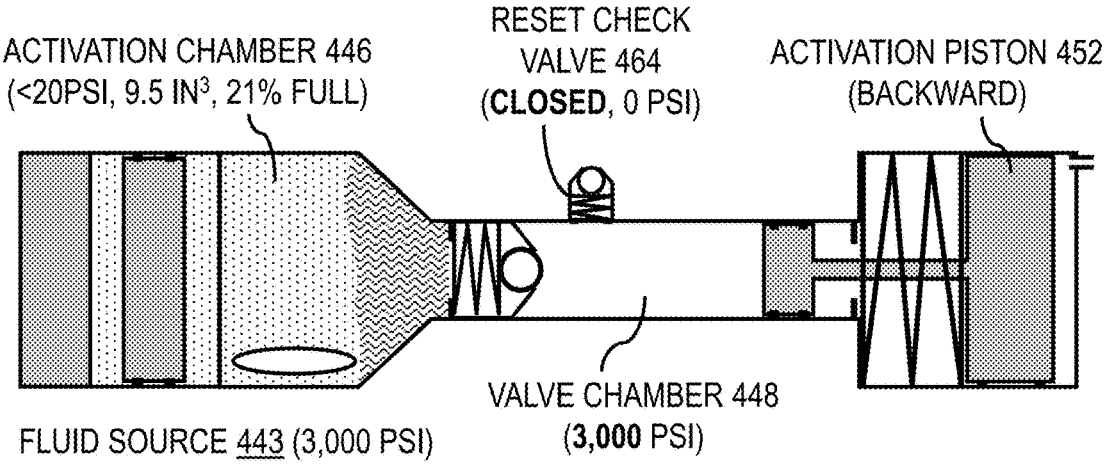
FIG. 6F is a diagram of an example embodiment of a hydraulic ratcheting device after completing a full cycle, with a partially filed activation chamber.

FIG. 6A is a diagram of an example embodiment of a hydraulic ratcheting device after being placed in a borehole, at a desired depth. FIG. 6B is a diagram of an example embodiment of a hydraulic ratcheting device after the activation piston is moved forward. FIG. 6C is a diagram of an example embodiment of a hydraulic ratcheting device after the liquid is pushed into the activation chamber. FIG. 6D is a diagram of an example embodiment of a hydraulic ratcheting device after pressure in the borehole is reduced. FIG. 6E is a diagram of an example embodiment of a hydraulic ratcheting device after the activation piston is pushed backward. FIG. 6F is a diagram of an example embodiment of a hydraulic ratcheting device after completing a full cycle, with a partially filed activation chamber.

In FIG. 6A, an example hydraulic ratcheting device 344 is shown that substantially matches the description of component properties described in FIG. 5A. Further, the example hydraulic ratcheting device 344 is depicted at a point in time that substantially matches T00 of FIG. 5B.

In FIG. 6B, the example hydraulic ratcheting device 344 is depicted at points in time that substantially match T01, T02, and T03 of FIG. 5B.

In FIG. 6C, the example hydraulic ratcheting device 344 is depicted at points in time that substantially match T04, T05, and T06 of FIG. 5B.

In FIG. 6D, the example hydraulic ratcheting device 344 is depicted at points in time that substantially match T07 and T08 of FIG. 5B.

In FIG. 6E, the example hydraulic ratcheting device 344 is depicted at points in time that substantially match T09, T10, and T11 of FIG. 5B.

In FIG. 6F, the example hydraulic ratcheting device 344 is depicted at points in time that substantially match T12 and T13 of FIG. 5B.

FIGS. 7A-7E

Figure 7A:
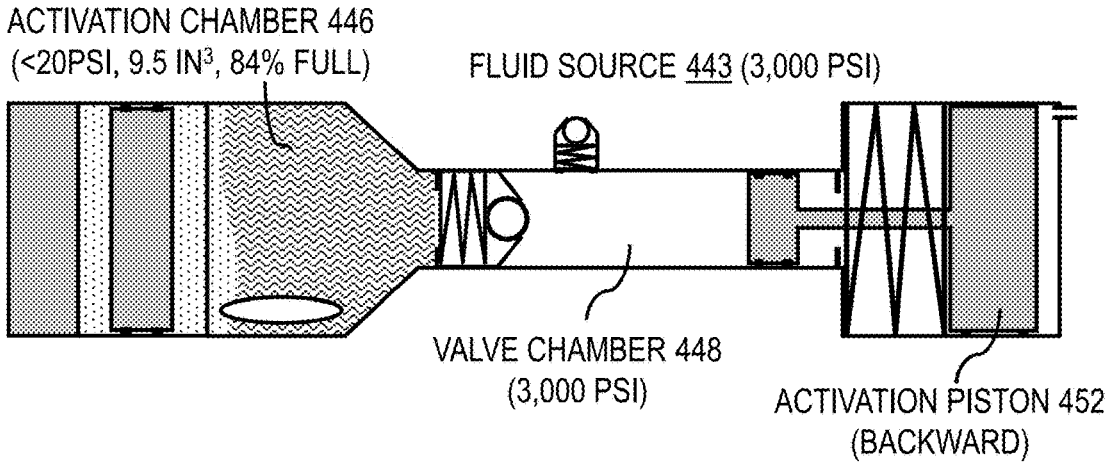
FIG. 7A is a diagram of an example embodiment of a hydraulic ratcheting device after being placed in a borehole, at a desired depth.
Figure 7B:
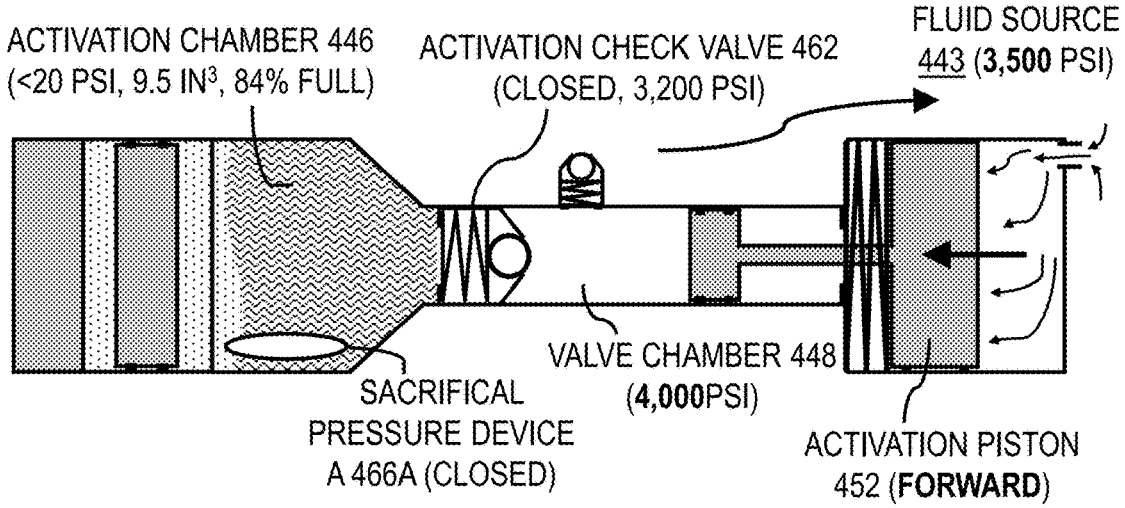
FIG. 7B is a diagram of an example embodiment of a hydraulic ratcheting device after the activation piston is moved forward.
Figure 7C:
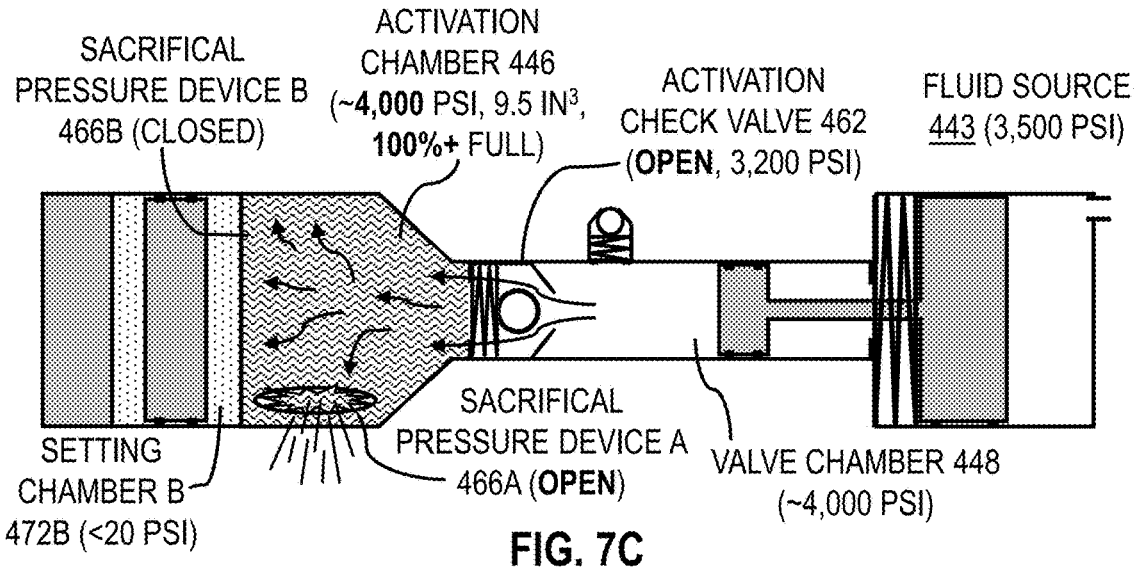
FIG. 7C is a diagram of an example embodiment of a hydraulic ratcheting device after the liquid is pushed into the activation chamber and a first sacrificial pressure device opens.
Figure 7D:
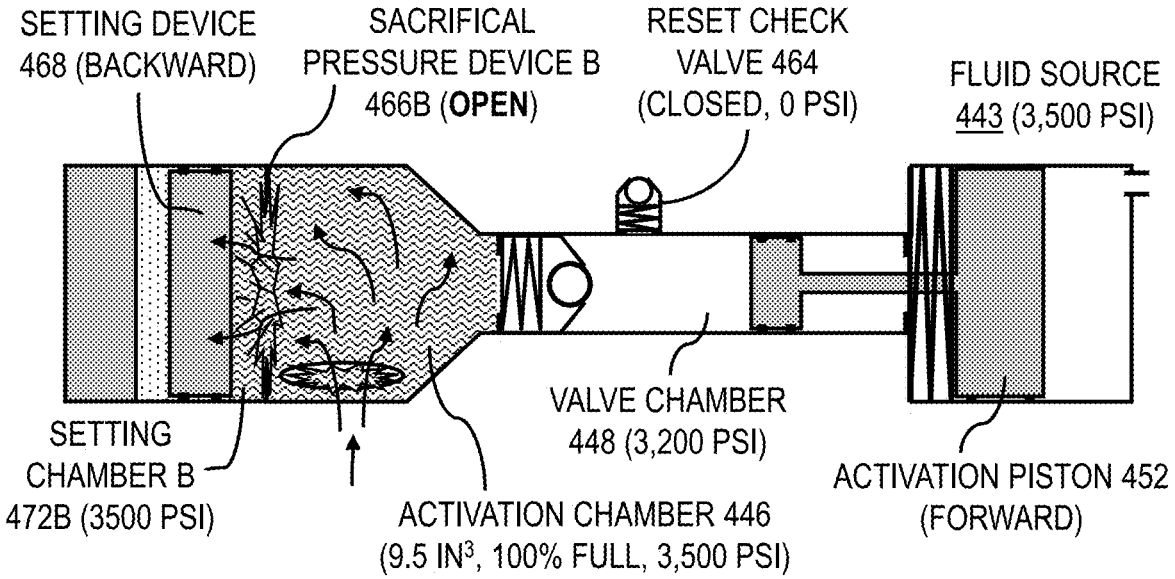
FIG. 7D is a diagram of an example embodiment of a hydraulic ratcheting device after a second sacrificial pressure device opens.
Figure 7E:
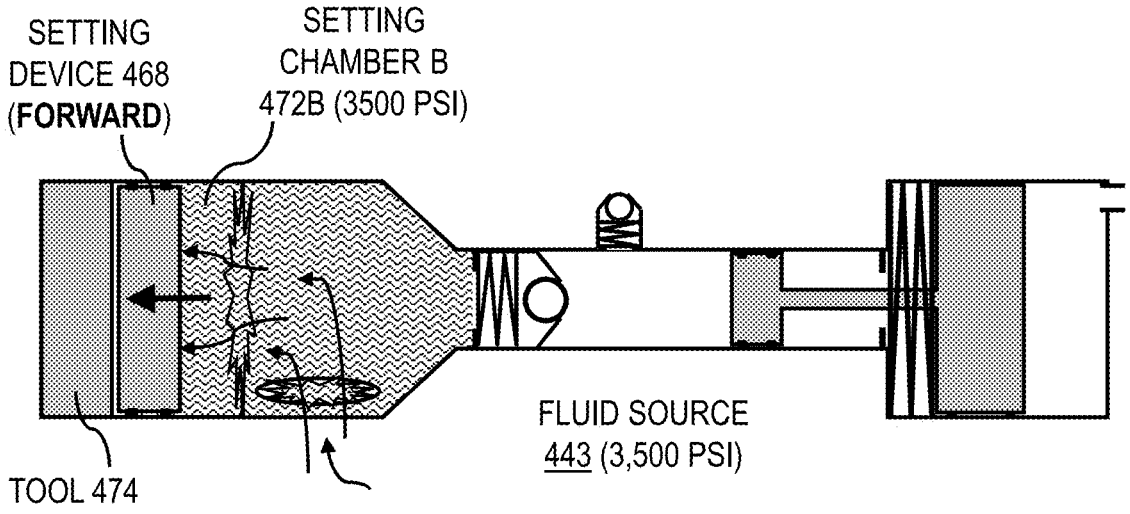
FIG. 7E is a diagram of an example embodiment of a hydraulic ratcheting device after a setting piston is pushed forward.

FIG. 7A is a diagram of an example embodiment of a hydraulic ratcheting device after being placed in a borehole, at a desired depth. FIG. 7B is a diagram of an example embodiment of a hydraulic ratcheting device after the activation piston is moved forward. FIG. 7C is a diagram of an example embodiment of a hydraulic ratcheting device after the liquid is pushed into the activation chamber and a first sacrificial pressure device opens. FIG. 7D is a diagram of an example embodiment of a hydraulic ratcheting device after a second sacrificial pressure device opens. FIG. 7E is a diagram of an example embodiment of a hydraulic ratcheting device after a setting piston is pushed forward.

The examples of FIGS. 7A-7E depict an embodiment of hydraulic ratcheting device 344 similar to that depicted in FIG. 4A. One of ordinary skill in the art, provided the benefit of this detailed description, would understand that the embodiments depicted in FIGS. 4B-4E may function similarly (with differences depending on the components used therein) to achieve the same overall function.

In FIG. 7A, an example hydraulic ratcheting device 344 is shown that substantially matches the description of component properties described in FIG. 5A. Further, the example hydraulic ratcheting device 344 is depicted at a point in time that substantially matches T52 of FIG. 5B.

In FIG. 7B, the example hydraulic ratcheting device 344 is depicted at points in time that substantially match T53, T54, and T55 of FIG. 5B.

In FIG. 7C, the example hydraulic ratcheting device 344 is depicted at a point in time that substantially matches T56 of FIG. 5B. Further, the 2 $in^3$ of liquid forced into activation chamber 446 (from valve chamber 448) is greater than the remaining volume in activation chamber 446. Accordingly, as the liquid is forced into activation chamber 446, the pressure in activation chamber 446 approaches 4,000 psi. Consequently, the pressure differential between activation chamber 446 and fluid source 443 exceeds 200 psi causing sacrificial pressure device A 466A to break open (as the "weak" side of sacrificial pressure device A 466A is disposed to activation chamber 446).

In FIG. 7D, the example hydraulic ratcheting device 344 is shown with sacrificial pressure device A 466A open and liquid from fluid source 443 flowing into activation chamber 446. Consequently, as activation chamber 446 and fluid source 443 are fluidly coupled, the pressure in activation chamber 446 becomes 3,500 psi. Setting chamber B 472B (disposed on the "strong" side of sacrificial pressure device B 466B) has a comparatively small pressure (e.g., less than 20 psi, 1 atm, 14.7 psi, etc.). Accordingly, the differential pressure between activation chamber 446 and setting chamber B 472B exceeds, at least, 3,480 psi. In turn, sacrificial pressure device B 466B breaks open, as sacrificial pressure device B 466B has a breaking pressure of 2,000 psi.

In FIG. 7E, the example hydraulic ratcheting device 344 is shown with sacrificial pressure device B 466B open and liquid from activation chamber 446 flowing into setting chamber B 472B. In turn, the setting piston 468 moves from a backward position to a forward position (caused by the increase in pressure on the side of setting piston 468 exposed to setting chamber B 472B).

Solutions and Improvements

The methods and systems described above are an improvement over the current technology as the methods and systems described herein provide a hydraulic ratcheting device that allows for a preset number of pressure increase cycles in a borehole before activating a tool.

Conventional hydrostatically activated tools are activated when the downhole pressure on the tool exceeds a certain threshold after a single instance. However, a hydraulic ratcheting device (as disclosed herein) allows for two or more pressure increase cycles before activating. That is, a hydraulic ratcheting device may be placed to activate the tool, where the preset pressure threshold must be exceeded a preset number of times before the tool is activated. As such, an operator may perform some (limited) number of cycles of pressure increases (for whatever purpose) before the tool is activated.

Statements

The systems and methods may comprise any of the various features disclosed herein, comprising one or more of the following statements.

Statement 1. A hydraulic ratcheting device, comprising an activation chamber a valve chamber disposed adjacent to the activation chamber; an activation piston, comprising a first piston area exposed to a fluid source; a second piston area exposed to the valve chamber wherein the activation piston is configured to translate forward, in response to a pressure increase on the first piston area; push a liquid from the valve chamber into the activation chamber using the second piston area.

Statement 2. The hydraulic ratcheting device of statement 1, further comprising a sacrificial pressure device a secondary activation chamber disposed adjacent to the sacrificial pressure device; a puncture piston or a spike disposed between the activation chamber and the secondary activation chamber.

Statement 3. The hydraulic ratcheting device of statement 2, wherein the puncture piston or the spike is configured to translate forward in response to an increase in an activation chamber pressure.

Statement 4. The hydraulic ratcheting device of statement 3, wherein the puncture piston or the spike is configured to open the sacrificial pressure device in response to translating forward.

Statement 5. The hydraulic ratcheting device of statements 1-4, wherein the activation piston is further configured to translate backward, in response to a pressure decrease on the first piston area.

Statement 6. The hydraulic ratcheting device of statement 5, further comprising a spring configured to apply a backward force on the activation piston.

Statement 7. The hydraulic ratcheting device of statement 6, wherein the first piston area is greater than the second piston area.

Statement 8. The hydraulic ratcheting device of statements 5-7, wherein after translating backward, the activation piston is further configured to translate forward, in response to a second pressure increase on the first piston area; push additional liquid from the valve chamber into the activation chamber using the second piston area.

Statement 9. The hydraulic ratcheting device of statement 8, further comprising a setting piston disposed adjacent to a tool.

Statement 10. The hydraulic ratcheting device of statement 9, wherein after the additional liquid is pushed into the activation chamber, the setting piston is configured to translate forward towards the tool.

Statement 11. The hydraulic ratcheting device of statements 1-10, further comprising an activation check valve disposed between the activation chamber and the valve chamber wherein the activation check valve is configured to allow a fluid to flow from the valve chamber to the activation chamber, wherein the activation check valve is configured to prevent the fluid from flowing from the activation chamber to the valve chamber.

Statement 12. The hydraulic ratcheting device of statements 1-11, further comprising a reset check valve disposed between the valve chamber and the fluid source wherein the reset check valve is configured to allow a fluid to flow from the fluid source to the valve chamber, wherein the reset check valve is configured to prevent the fluid from flowing from the valve chamber to the fluid source.

Statement 13. A method for actuating a hydraulic ratcheting device, comprising lowering the hydraulic ratcheting device into a borehole, wherein the hydraulic ratcheting device comprises an activation piston; an activation chamber increasing a fluid source pressure of a fluid source of the borehole, wherein in response to increasing the fluid source pressure the activation piston shifts forward; increasing a volume of liquid in the activation chamber; decreasing the fluid source pressure, wherein in response to decreasing the fluid source pressure the activation piston shifts backward.

Statement 14. The method of statement 13, further comprising increasing the fluid source pressure again, wherein in response to increasing the fluid source pressure again increasing the volume of liquid in the activation chamber, causing a sacrificial pressure device to open, wherein the sacrificial pressure device is disposed between the activation chamber and the fluid source.

Statement 15. The method of statement 14, wherein, in response to increasing the fluid source pressure again, the method further comprises opening a second sacrificial pressure device disposed between the activation chamber and a setting piston.

Statement 16. The method of statements 14-15, wherein, in response to increasing the fluid source pressure again, the method further comprises breaking a sacrificial mechanical coupling attached to a setting piston.

Statement 17. The method of statements 13-16, wherein, in response to the activation piston shifting forward increasing a valve chamber pressure, in a valve chamber of the hydraulic ratcheting device.

Statement 18. The method of statement 17, wherein, in response to the valve chamber pressure increasing an activation check valve opens, wherein the activation check valve is disposed between the valve chamber and the activation chamber.

Statement 19. The method of statement 18 wherein, in response to the activation check valve opening liquid flows from the valve chamber to the activation chamber, through the activation check valve, causing the activation check valve to close wherein, in response to the activation piston shifting backward the valve chamber pressure decreases causing a reset check valve to open, wherein the reset check valve is disposed between the valve chamber and the fluid source.

Statement 20. A hydraulic ratcheting device, comprising an activation chamber, comprising a puncture piston, or a spike a valve chamber disposed adjacent to the activation chamber, an activation piston, comprising a first piston area exposed to a fluid source, a second piston area exposed to the valve chamber.

General Notes

As it is impracticable to disclose every conceivable embodiment of the technology described herein, the figures, examples, and description provided herein disclose only a limited number of potential embodiments. A person of ordinary skill in the relevant art would appreciate that any number of potential variations or modifications may be made to the explicitly disclosed embodiments, and that such alternative embodiments remain within the scope of the broader technology. Accordingly, the scope should be limited only by the attached claims. Further, the compositions and methods are described in terms of "comprising," "containing," or "including" various components or steps, the compositions and methods may also "consist essentially of" or "consist of" the various components and steps. Moreover, the indefinite articles "a" or "an," as used in the claims, are defined herein to mean one or more than one of the elements that it introduces. Certain technical details, known to those of ordinary skill in the relevant art, may be omitted for brevity and to avoid cluttering the description of the novel aspects.

For further brevity, descriptions of similarly named components may be omitted if a description of that similarly named component exists elsewhere in the application. Accordingly, any component described with respect to a specific figure may be equivalent to one or more similarly named components shown or described in any other figure, and each component incorporates the description of every similarly named component provided in the application (unless explicitly noted otherwise). A description of any component is to be interpreted as an optional embodiment-which may be implemented in addition to, in conjunction with, or in place of an embodiment of a similarly-named component described for any other figure.

Lexicographical Notes

As used herein, adjective ordinal numbers (e.g., first, second, third, etc.) are used to distinguish between elements and do not create any ordering of the elements. As an example, a "first element" is distinct from a "second element", but the "first element" may come after (or before) the "second element" in an ordering of elements. Accordingly, an order of elements exists only if ordered terminology is expressly provided (e.g., "before", "between", "after", etc.) or a type of "order" is expressly provided (e.g., "chronological", "alphabetical", "by size", etc.). Further, use of ordinal numbers does not preclude the existence of other elements. As an example, a "table with a first leg and a second leg" is any table with two or more legs (e.g., two legs, five legs, thirteen legs, etc.). A maximum quantity of elements exists only if express language is used to limit the upper bound (e.g., "two or fewer", "exactly five", "nine to twenty", etc.). Similarly, singular use of an ordinal number does not imply the existence of another element. As an example, a "first threshold" may be the only threshold and therefore does not necessitate the existence of a "second threshold".

As used herein, indefinite articles "a" and "an" mean "one or more". That is, the explicit recitation of "an" element does not preclude the existence of a second element, a third element, etc. Further, definite articles (e.g., "the", "said") mean "any one of" (the "one or more" elements) when referring to previously introduced element(s). As an example, there may exist "a processor", where such a recitation does not preclude the existence of any number of other processors. Further, "the processor receives data, and the processor processes data" means "any one of the one or more processors receives data" and "any one of the one or more processors processes data". It is not required that the same processor both (i) receive data and (ii) process data. Rather, each of the steps ("receive" and "process") may be performed by different processors.

Herein, "uphole" and "downhole" are often used to provide an orientation with respect to the larger borehole in which one or more components reside. However, when used to describe two ends of a single component-without reference to a larger borehole-then the designation of "uphole" and "downhole" may be arbitrary and only intended to provide a description of the orientation with respect to those components disclosed. As an example, the hydraulic ratcheting devices shown in FIGS. 4A, 4B, and 4C may be inverted vertically (i.e., flipped upside-down) making all "downhole" sides "uphole", and conversely making all "uphole" sides "downhole". One of ordinary skill in the art, provided the benefit of this detailed description, would understand that the hydraulic ratcheting device would function similarly, and such embodiments do not depart from the scope of this disclosure.

Herein, "[volume] pressure" (e.g., "fluid source pressure", "valve chamber pressure", "activation chamber pressure", etc.) refers to the absolute pressure (i.e., compared to perfect vacuum (0 psi, 0 atm, 0 pascals)) inside the 'volume' referenced. That is, as a non-limiting example, "valve chamber pressure" refers to the absolute pressure in valve chamber 448, and "activation chamber pressure" refers to the absolute pressure in activation chamber 446.

What is claimed is:

1. A hydraulic ratcheting device, comprising:
an activation chamber;
a valve chamber disposed adjacent to the activation chamber; and
an activation piston, comprising:
a first piston area exposed to a fluid source; and
a second piston area exposed to the valve chamber,
wherein the activation piston is configured to:
translate forward, in response to a pressure increase on the first piston area; and
push a liquid from the valve chamber into the activation chamber using the second piston area; and
a reset check valve disposed between the valve chamber and the fluid source, wherein the reset check valve is configured to:
allow a fluid to flow from the fluid source to the valve chamber, and prevent the fluid from flowing from the valve chamber to the fluid source.

2. The hydraulic ratcheting device of claim 1, further comprising:
an activation check valve disposed between the activation chamber and the valve chamber,
wherein the activation check valve is configured to allow a fluid to flow from the valve chamber to the activation chamber, and
wherein the activation check valve is configured to prevent the fluid from flowing from the activation chamber to the valve chamber.

3. The hydraulic ratcheting device of claim 1, wherein the first piston area is greater than the second piston area.

4. The hydraulic ratcheting device of claim 1, wherein after translating backward, the activation piston is further configured to:
translate forward, in response to a second pressure increase on the first piston area; and
push additional liquid from the valve chamber into the activation chamber using the second piston area.

5. The hydraulic ratcheting device of claim 4, further comprising:
a setting piston disposed adjacent to a tool,
wherein after the additional liquid is pushed into the activation chamber, the setting piston is configured to: translate towards the tool.

6. A hydraulic ratcheting device, comprising:
an activation chamber;
a sacrificial pressure device;
a secondary activation chamber disposed adjacent to the sacrificial pressure device;
a puncture piston or a spike disposed between the activation chamber and the secondary activation chamber;
a valve chamber disposed adjacent to the activation chamber; and
an activation piston, comprising:
a first piston area exposed to a fluid source; and
a second piston area exposed to the valve chamber,
wherein the activation piston is configured to:
translate forward, in response to a pressure increase on the first piston area; and
push a liquid from the valve chamber into the activation chamber using the second piston area.

7. The hydraulic ratcheting device of claim 6, wherein in response to an increase in an activation chamber pressure, the puncture piston or the spike is configured to translate forward.

8. The hydraulic ratcheting device of claim 7, wherein in response to the puncture piston or the spike translating forward, the puncture piston or the spike is configured to open the sacrificial pressure device.

9. The hydraulic ratcheting device of claim 6, wherein the first piston area is greater than the second piston area.

10. The hydraulic ratcheting device of claim 6, wherein after translating backward, the activation piston is further configured to:
translate forward, in response to a second pressure increase on the first piston area; and
push additional liquid from the valve chamber into the activation chamber using the second piston area.

11. The hydraulic ratcheting device of claim 10, further comprising:
a setting piston disposed adjacent to a tool,
wherein after the additional liquid is pushed into the activation chamber, the setting piston is configured to: translate towards the tool.

12. The hydraulic ratcheting device of claim 6, further comprising:
an activation check valve disposed between the activation chamber and the valve chamber,
wherein the activation check valve is configured to allow a fluid to flow from the valve chamber to the activation chamber, and
wherein the activation check valve is configured to prevent the fluid from flowing from the activation chamber to the valve chamber.

13. A hydraulic ratcheting device, comprising:
an activation chamber;
a valve chamber disposed adjacent to the activation chamber;
an activation piston, comprising:
a first piston area exposed to a fluid source; and
a second piston area exposed to the valve chamber; and
a spring configured to apply a backward force on the activation piston,
wherein the activation piston is configured to:
translate forward, in response to a pressure increase on the first piston area;
push a liquid from the valve chamber into the activation chamber using the second piston area; and
translate backward, in response to a pressure decrease on the first piston area.

14. The hydraulic ratcheting device of claim 13, wherein the first piston area is greater than the second piston area.

15. The hydraulic ratcheting device of claim 13, wherein after translating backward, the activation piston is further configured to:
translate forward, in response to a second pressure increase on the first piston area; and
push additional liquid from the valve chamber into the activation chamber using the second piston area.

16. The hydraulic ratcheting device of claim 15, further comprising:
a setting piston disposed adjacent to a tool,
wherein after the additional liquid is pushed into the activation chamber, the setting piston is configured to: translate towards the tool.

17. The hydraulic ratcheting device of claim 13, further comprising:

an activation check valve disposed between the activation chamber and the valve chamber, wherein the activation check valve is configured to allow a fluid to flow from the valve chamber to the activation chamber, and wherein the activation check valve is configured to prevent the fluid from flowing from the activation chamber to the valve chamber.

18. A method for actuating a hydraulic ratcheting device, comprising:

lowering the hydraulic ratcheting device into a borehole, wherein the hydraulic ratcheting device comprises:

an activation piston; and an activation chamber;

increasing a fluid source pressure of a fluid source of the borehole, wherein in response to increasing the fluid source pressure:

the activation piston shifts forward; and increasing a volume of liquid in the activation chamber;

decreasing the fluid source pressure, wherein in response to decreasing the fluid source pressure:

the activation piston shifts backward; and increasing the fluid source pressure again, wherein in response to increasing the fluid source pressure again:

increasing the volume of liquid in the activation chamber, causing a sacrificial pressure device to open, wherein the sacrificial pressure device is disposed between the activation chamber and the fluid source.

19. The method of claim 18, wherein, in response to increasing the fluid source pressure again, the method further comprises:

opening a second sacrificial pressure device disposed between the activation chamber and a setting piston.

20. The method of claim 18, wherein, in response to increasing the fluid source pressure again, the method further comprises:

breaking a sacrificial mechanical coupling attached to a setting piston.

21. A method for actuating a hydraulic ratcheting device, comprising:

lowering the hydraulic ratcheting device into a borehole, wherein the hydraulic ratcheting device comprises:

an activation piston;

an activation chamber;

a valve chamber;

an activation check valve disposed between the valve chamber and the activation chamber; and a reset check valve disposed between the valve chamber and a fluid source;

increasing a fluid source pressure of the fluid source of the borehole, wherein in response to increasing the fluid source pressure:

the activation piston shifts forward;

in response to the activation piston shifting forward, increasing a valve chamber pressure in the valve chamber;

in response to the valve chamber pressure increasing, the activation check valve opens;

in response to the activation check valve opening, liquid flows from the valve chamber to the activation chamber, through the activation check valve;

in response to liquid flowing to the activation chamber, the activation check valve to closes; and increasing a volume of liquid in the activation chamber; and decreasing the fluid source pressure, wherein in response to decreasing the fluid source pressure:

the activation piston shifts backward; and in response to the activation piston shifting backward, the valve chamber pressure decreases causing the reset check valve to open.

22. The method of claim 21, wherein, in response to increasing the fluid source pressure again, the method further comprises:

opening a second sacrificial pressure device disposed between the activation chamber and a setting piston.

23. The method of claim 21, wherein, in response to increasing the fluid source pressure again, the method further comprises:

breaking a sacrificial mechanical coupling attached to a setting piston.

* * * * *